US009005018B2

(12) United States Patent
Maddhali

(10) Patent No.: US 9,005,018 B2
(45) Date of Patent: Apr. 14, 2015

(54) SELECTING PREFERRED ELECTRONIC GAMING MACHINES HAVING AN AVAILABILITY FOR USE

(71) Applicant: IGT, Reno, NV (US)

(72) Inventor: Durga S. Maddhali, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/786,717

(22) Filed: Mar. 6, 2013

(65) Prior Publication Data

US 2014/0256417 A1 Sep. 11, 2014

(51) Int. Cl.
*G07F 17/32* (2006.01)

(52) U.S. Cl.
CPC ..... *G07F 17/323* (2013.01); *G07F 17/3232* (2013.01); *G07F 17/3237* (2013.01); *G07F 17/3234* (2013.01); *G07F 17/3269* (2013.01); *G07F 17/3283* (2013.01)

(58) Field of Classification Search
CPC ..... A63F 2300/5593; G06Q 10/02; G06Q 10/028; G06Q 10/025; G07F 17/3227
USPC ..... 463/29, 31, 42
See application file for complete search history.

(56) References Cited

U.S. PATENT DOCUMENTS

| | | | | |
|---|---|---|---|---|
| 2002/0187834 | A1* | 12/2002 | Rowe et al. | 463/42 |
| 2007/0191111 | A1* | 8/2007 | Sylla et al. | 463/43 |
| 2010/0125789 | A1* | 5/2010 | Burke et al. | 715/706 |
| 2010/0323785 | A1* | 12/2010 | Motyl et al. | 463/25 |
| 2011/0183762 | A1* | 7/2011 | Topham et al. | 463/42 |
| 2011/0250960 | A1* | 10/2011 | Nguyen | 463/31 |
| 2012/0315981 | A1* | 12/2012 | Gagner et al. | 463/25 |
| 2013/0288778 | A1* | 10/2013 | Johnson | 463/25 |
| 2013/0288779 | A1* | 10/2013 | Chun | 463/25 |

* cited by examiner

*Primary Examiner* — Bach Hoang
*Assistant Examiner* — Kevin Carter
(74) *Attorney, Agent, or Firm* — Griffiths & Seaton PLLC

(57) ABSTRACT

A gaming system identifies, from a gaming network having a cluster of electronic gaming machines (EGMs), those of the EGMs having an availability and unavailability for use. Those of the EGMs having the availability for use are organized. A user selects one of the organized EGMs.

21 Claims, 17 Drawing Sheets

SELECTING PREFERRED ELECTRONIC GAMING MACHINES HAVING AN AVAILABILITY FOR USE

COPYRIGHT NOTICE

A portion of the disclosure of this patent document contains or may contain material, which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

1. Field of the Invention

The present invention relates in general to gaming devices and systems, and more particularly selecting preferred electronic gaming machines (EGMs) having an availability for use.

2. Description of the Related Art

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of games and, in some cases, the potential for increased awards associated with certain games.

Individuals and group players often times seek for popular, favorite, and/or preferred gaming devices (e.g., electronic gaming machines such as slot machines, video poker, and the like) that have large and frequent jackpots and awards, which are paid out at an increased rate compared to other gaming systems. Typically, awareness of the preferred and/or favorite gaming devices with large and/or frequent awards are based on word of mouth, notifications on the gaming device itself, and/or a users historical experience.

SUMMARY OF THE DESCRIBED EMBODIMENTS

A current challenge for gaming institutions, in view of increasingly popular use by players and an increasing number of gaming machines, tables and the like in gaming environments, is the providing of updated information to the player relating to one of many favored and specified electronic gaming machines (EGMs) that are available for use. For example, a player may search a particular gaming establishment, expending time and other resources in the search for a particular and preferred machine (e.g., a favorite EGM) thought to be successful.

To address these aforementioned needs, in one embodiment, by way of example only, a method is provided for processing data in a gaming system having at least one processor device. A gaming system identifies, from a gaming network having a cluster of electronic gaming machines (EGMs), those of the EGMs having an availability and unavailability for use. Those of the EGMs having the availability for use are organized. A user selects one of the organized EGMs.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
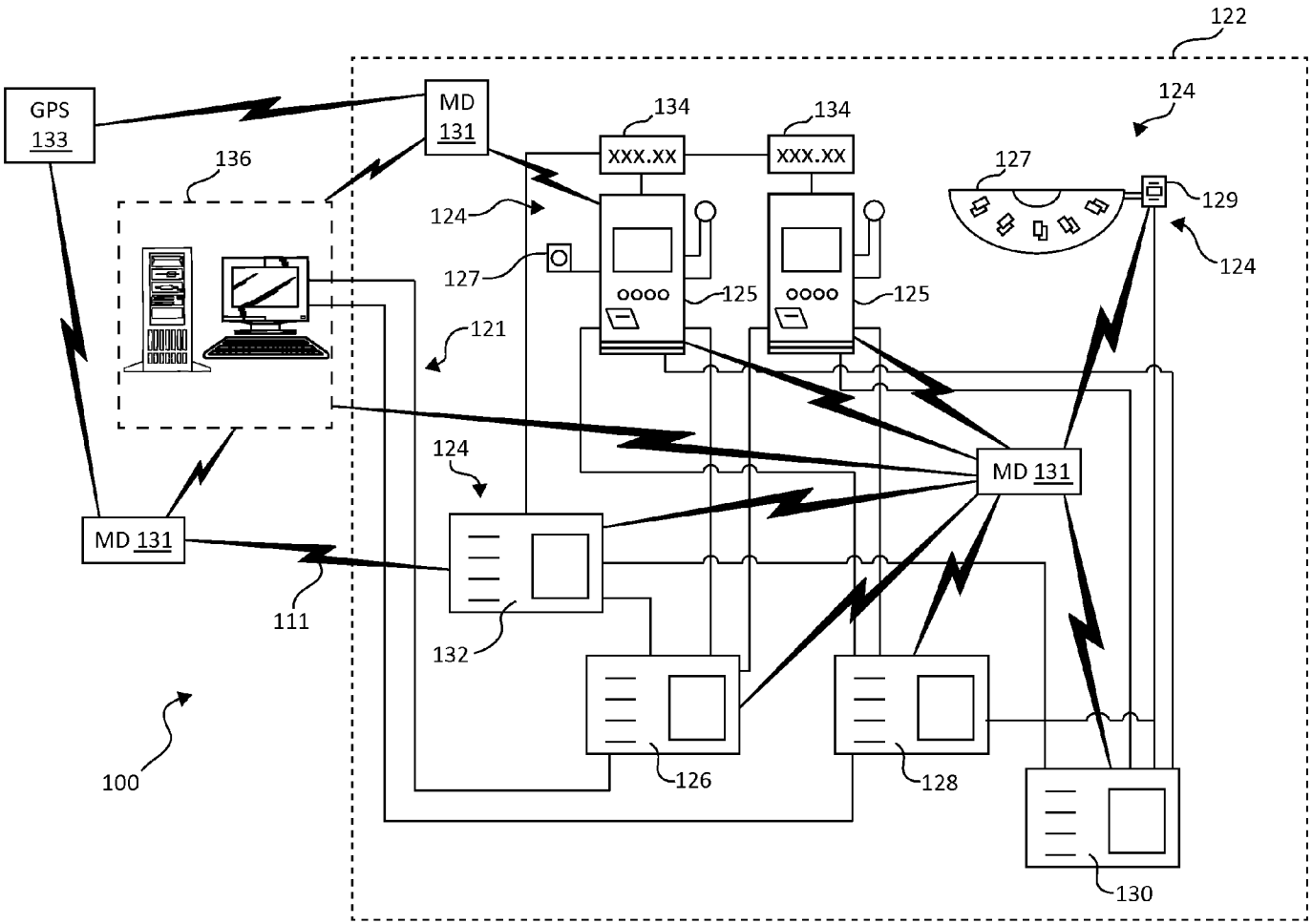
FIG. 1 is a block diagram illustrating a gaming system environment with a gaming terminal data repository (GTDR) connected via one or more network interface(s) to a gaming network which, for example, may include gaming devices (e.g., gaming terminals), in which aspects of the present invention may be realized.

In general, gaming machines require a player to place or make a wager to activate a primary or base game. The award may be based on the player obtaining a winning symbol symbol combination and on the amount of the wager (e.g., the higher the wager, the higher the award). Symbols or symbol combinations that are less likely to occur usually provide higher awards. In such gaming machines, the amount of the wager made on the base game by the player may vary. For instance, a gaming machine may allow the player to wager a minimum number of credits, such as one credit (e.g., one penny, nickel, dime, quarter or dollar) up to a maximum number of credits, such as five credits. The player may make this wager a single time or multiple times in a single play of a primary game. For instance, a slot game may have one or more pay lines and the slot game may allow the player to make a wager on each pay line in a single play of the primary game. Slot games with 1, 3, 5, 9, 15 and 25 lines may be provided. Thus, a gaming device, such as a slot game, may allow players to make wagers of substantially different amounts on each play of the primary or base game ranging, for example, from one credit up to 125 credits (e.g., five credits on each of 25 separate pay lines). This is also true for other wagering games, such as video draw poker, where players can wager one or more credits on each hand and where multiple hands can be played simultaneously. Different players play at substantially different wagering amounts or levels and at substantially different rates of play.

Secondary or bonus games may also be provided in the gaming machines. The secondary or bonus games may provide an additional award to the player. Secondary or bonus games may not require an additional wager by the player to be activated. Secondary or bonus games may be activated or triggered upon an occurrence of a designated triggering symbol or triggering symbol combination in the primary or base game. For instance, a bonus symbol occurring on the pay line on the third reel of a three-reel slot machine may trigger the secondary bonus game. When a secondary or bonus game is triggered, the gaming machines may indicate this to the player through one or more visual and/or audio output devices, such as the reels, lights, display units, speakers, video screens, etc. Part of the enjoyment and excitement of playing certain gaming machines is the occurrence of the secondary or bonus game (even before the player knows how much the bonus award will be). In other words, obtaining a bonus award is part of the enjoyment and excitement for players.

Progressive awards may also be provided in gaming machines. A progressive award may be an award amount that includes an initial amount funded by a casino and an additional amount funded through a portion of each wager made on the progressive gaming machine. For example, 1% to 5% of each wager placed on the primary game of the gaming machine associated with the progressive award may be allocated to the progressive award or progressive award fund. The progressive award grows in value as more players play the gaming machine, and thus, portions of these players' wagers are allocated to the progressive award. When a player obtains a winning symbol or symbol combination, which results in the progressive award, the accumulated progressive award is provided to the player. After the progressive award is provided to the player, the amount of the next progressive award may be reset to an initial value, a predetermined value, or randomly generated value, and a portion of each subsequent wager on a gaming machine associated with the progressive is allocated to the next progressive award as described above.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressive ("LAP") and wide area progressive ("WAP"), respectively. Progressive awards may increment through communication between a progressive controller and one or more gaming machines. The gaming machines associated with the progressive award transfer coin-in information to a progressive controller. From this information, the progressive controller calculates how much to increment the progressive award based on a set increment rate and then increments the progressive award accordingly. The gaming machines may provide the player a choice between different wager levels prior to the commencement of a primary game. The different wager levels enable the player to win different progressive awards. The gaming devices provide a progressive jackpot where the value of the jackpot may increase by a particular amount for every game played. Thus, when multiple gaming devices are linked together to form one large progressive jackpot, the jackpot grows more quickly because multiple players are contributing to the jackpot at the same time.

In one embodiment, there may be one or more various types of EGM machines, each having a variety of gaming themes, on any casino floor (and/or other gaming venue) using the above described gaming systems. The EGMs may uses the various gaming award systems, jackpots, progressive jackpots, and/or other type of gaming systems and awards. As mentioned above, users of the various gaming devices (e.g., an EGM) have a general interest in, and may expend resources trying to identify, which of these various and preferred EGMs are paying out the largest and most frequent awards and/or progressive jackpots. As such, a need exist for providing in real time, to a user, one or more of the user's favorite and/or preferred EGMs, and/or a list of EGM devices available and/or unavailable in the gaming venue, in order to play one or more of the favorite and/or preferred EGMs (e.g., the EGM labeled as "Wheel of fortune"). A need exists for providing to the user the location of one or more of the favorite and/or preferred EGMs the user desire to play. Also, users who are awarded a monetary value and/or jackpot award on a particular EGM often times seek to play on these same award winning EGMs at a subsequent time (e.g., a return visit). If one or more of those favorite and/or preferred EGMs are occupied or unavailable, a need exists for a user to know if one or more of the favorite and/or preferred EGMs are not occupied or not available, prior to manually locating such favorite and/or preferred EGMs. A need also exist for indicating to those users an average time in which one or more of the favorite and/or preferred EGMs may be become unoccupied and available for use.

To address these aforementioned needs, in one embodiment, by way of example only, a gaming system identifies, from a gaming network having a cluster of electronic gaming machines (EGMs), those of the EGMs having an availability and unavailability for use. Those of the EGMs having the availability for use are organized according to one or more predetermined preferences (e.g., user preferences). A user then selects one of the organized EGMs. For example, as will be described below, a user may select in an information window (e.g., a service window) of the EGM and/or via an external application, one or more favorite and/or preferred organized EGMs.

In one embodiment, a percentage of occupancy and a percentage of unoccupancy of the EGMs may be displayed. A listing of those of the identified EGMs having the availability and the unavailability for use may be displayed in an information window. The listing of the identified EGMs having the availability and the unavailability for use may include both occupied (e.g., the EGM is currently in use by another player) and unoccupied EGMs. At least one or more circuitous routes may be on a map in the information window and/or external application for directing the user to the one of the organized EGMs (e.g., to one or more of the favorite and/or preferred EGMs.

In one embodiment, each one of the EGMs is monitored using a monitoring system remotely located in the gaming network. Data is harvested from each one of the EGMs using the monitoring system. In one embodiment, the data includes at least statistical information, historical use information associated with each one of the EGM' and the user, accounting information, wagering data, and gaming and members profile information associated with the user, predetermined preferences for indicating a users favorite and/or preferred game/EGM, and various information and data acquired via a player tracking system. In one embodiment, the collected data may be stored in one of a variety storage locations, such as a remote storage system that is in communication with each EGM. The data may be collected, harvested, updated, stored, and/or accessed in real time.

In one embodiment, at least a portion of the data and geolocation data that is associated with each one of the EGMs is published to and/or displayed in the information window and/or external application. The information window may be updated in real time with the harvested data from each one of the EGMs (e.g., the favorite and/or preferred EGM).

In one embodiment, if the user selects one of the organized EGMs (e.g., one of the organized EGMs that is a favorite and/or a preferred EGM) that has an occupied indication, the user may select an alternative one of the organized EGMs and/or a group of the of the organized EGMs. In one embodiment, the percentage of occupancy for the organized EGM and/or the group of the organized EGMs that is selected by the user is displayed, and at least one circuitous routes is displayed on a map in an information window and/or external application for each one of the organized EGMs selected by the user with an unoccupied indication.

In one embodiment, a gaming venue may be defined; including defining a number of the EGMs from data that is harvested and/or collected by a controller (e.g., a master gaming controller) and/or a monitoring system. The gaming venue may be defined as one or more casinos, one or more floors of the one or more casinos, a defined and/or restricted section of the one or more casinos, one or more of a specified gaming device (e.g., all video poker gaming devices), one or more of any combination of gaming devices, one or more gaming devices based on the manufacturer or owner, and/or single or multiple venues (e.g., a restaurant and/or a chain of convenience restaurants, a business and/or a chain of businesses, a convenience store and/or a chain of convenience stores, a hotel and/or a chain of hotels, an organization, and/or combination of any type of business, entity, and/or organization providing gaming entertainment, etc.). The venue may be defined at a local, regional, state, country, and/or international level. For example, a casino operator having multiple casinos throughout the world may define the gaming venue to be all casinos throughout the world, having a particular gaming device, to be the gaming venue for purposes of progressive value tracking. In another embodiment, by way of example only, a casino may define the gaming venue to be all gaming devices located on a specified floor (e.g., $1^{st}$ floor of the casino). In still an alternative embodiment, casinos owned and operated by different entities, having a business relationship, may define the gaming devices to only those gaming devices within the casinos of the business relationship. As one of ordinary skill in the art will appreciate, the applicable venue in which EGMs are used may vary according to business/organizational need, a particular application, or other factors.

In one embodiment, as described herein, an external application or other mechanism may be used for processing and/or displaying the harvested data, identifying EGMs having the availability and unavailability for use, organizing the EGMs, creating a list of organized EGMs, and using the information window for a user to select one or more of the EGMs. In addition, a scrolling text area may be provided to an external application for advertising any exclusive and non-exclusive memberships, promotions, and/or offers (e.g., promotions of a favorite and/or preferred EGM). This data may be uploaded in real time from a software add on product from the casino floor to a cellular network, a wireless RLAN (Radio Local Area Network) standard, commercially known as WIFI®, Wi-Fi or WIFI or other type of communication channel for display via the external application.

In one embodiment, by use of a player tracking system, vendors may provide for an exclusive membership club for users of the service window application and/or external application relating to one of the EGMs (e.g., membership club of the favourite and/or preferred EGM). A swipe card may be provided with the external application (e.g., mobile application, web application, and the like) to be used with the gaming device. In one embodiment, the external application provides for a variety of options for online betting to casino tables, games, and sports books, and or other types of online gaming services.

Turning now to FIG. 1, a block diagram illustrating a gaming system environment 100 is shown. Environment 100 includes a Gaming Terminal Data Repository (GTDR) connected via one or more network interface(s) to a gaming network which, for example, may include gaming devices (e.g., gaming terminals) and/or other devices, in which aspects of the present invention may be realized. As illustrated in FIG. 1, the gaming environment 100 may comprise a gaming system/environment 122 located in a physical environment (not shown). It will be appreciated that the communications links between the various components may be separate and distinct or may be commonly used. It will also be appreciated that one or more of the functions or applications described above may be consolidated, such as at a common server or host. Further, other components for implementing other functionality may be provided. For example, a variety of computing devices, such as user stations, may be connected to the various systems. Printers and other peripheral devices may also be connected to each network or system. A gaming system/environment 122 may be located at least partially in one or more physical gaming environments, such as a casino, restaurant, and/or convenience store. For example, the casino may include publicly accessible game areas where certain of the gaming system devices 124, such as gaming machines 125 and table games 127 are located, as well as secure areas where the servers and other components are located.

In one embodiment, the physical environment includes at least a portion of a physical structure, such as casino, housing one or more components of the gaming system/environment 122. The gaming system/environment 122 includes one or more gaming system devices 124 or components. The gaming system devices 124 may include gaming machines 125, such as those known as video or slot machines. The devices 124 may also include "table" games 127 such as Blackjack and Roulette. The gaming devices 124 may also include components or devices such as player tracking card readers 129, coin counters and other gaming devices functionality options, which devices or components may be linked or associated with other devices. The devices or components may also comprise computers or servers and communication equipment, cashier and accounting workstations and a wide variety of other elements.

In one embodiment, the gaming system/environment 122 may include a variety of sub-systems. These sub-systems may be partially or fully independent of one another or may be related. In one embodiment, each system may be included or be part of a network. In one embodiment, the gaming system/environment 122 may include a game presentation/operation system, which includes at least one game server 126. The game server 126 may comprise a computing device including a processor and a memory. The game server 126 may be adapted to perform a variety of functions. This functionality may be implemented by software and/or hardware of the server 126. In one embodiment, the game server 126 may be arranged to provide information or instructions to the one or more gaming devices 124 or individual gaming system components. The information may comprise game code and control data. In one embodiment, the game server 126 may also be arranged to accept information from the gaming devices 124 or components. For example, the game sever 126 may accept information regarding the status of operation of a particular gaming system device 124 (such as "normal" or "malfunction").

In one embodiment, the game server 126 is part of a network, which includes a communication link between the game server 126 and selected gaming system device(s) 124 and/or other component(s) with which communication is desired. A communication interface may be associated with the game server 126 and each device or component for facilitating the communication. The communication interfaces may have a variety of architectures and utilize a variety of protocols such as IEEE-1394 (FireWire™) or Ethernet in the case where the communication link is a wired link, or a wireless link utilizing a wireless protocol such as WIFI, Bluetooth™, Radio Frequency (RF), Infrared, etc. The communication links may transmit electrical, electromagnetic or optical signals, which carry digital data streams, or analog signals representing various types of information. In one embodiment, such as when the gaming device 124 comprises a gaming machine 125, the device 124 may include a master gaming controller, which controls the functions of game operation. The communication interface may be associated with the master gaming controller, permitting data to be transmitted between the game server 126 and the master gaming controller.

In one embodiment, the gaming system/environment 122 may include a player tracking system, which includes at least one player-tracking server 128. The player-tracking server 128 may also comprise a computing device including a processor and a memory. The player-tracking server 128 may be adapted to perform player-tracking functions. For example, the player-tracking server 128 may store information regarding the identities of players and information regarding the game play of those players. This information may include time of play, coin in/coin out or other monetary transaction data, and in an arrangement where players are awarded points based on play, a player's point total. Once again, the player tracking system includes a network comprising a communication link provided between the player tracking server 128 and one or more of the gaming devices 124 having a player tracking function or other components of the gaming system/environment 122 associated with the system. In one embodiment, such as where the gaming device 124 comprises a gaming machine, the device may include a management interface board, which controls a card reader. The management interface board may be arranged to receive data from the master gaming controller of the gaming system device 124. A communication interface is associated with the management interface board, permitting data to be transmitted between the player tracking server 128 and the management interface board.

In the case of table games, a card reader 129 may be associated with the table (e.g., the card reader located on or near the table game). Players may utilize the card reader to identify themselves. Information regarding play of the table game may be input through an input device by a dealer, coin counter or the like, and this information may be transmitted to the player tracking server 128.

In one embodiment, the gaming system/environment 122 may include an accounting system, which includes at least one accounting server 130. The accounting server 130 may comprise a computing device including a processor and a memory. The accounting server 130 is preferably adapted to perform financial related functions, such as track financial transactions such as bets and payouts, and perform reconciliations with monies collected from the gaming system devices 124, such as gaming machines 125, tables games 127. The accounting server 30 may be associated with a wide variety of devices, including individual gaming system devices 124 and other servers. Once again, a communication link may be provided between the accounting server 130 and each device with which communications is desired.

In one embodiment, the gaming system/environment 122 may include a progressive award system, which includes at least one progressive server 132. The progressive sever 132 may comprise a computing device including a processor and a memory. The progressive server 132 may be designed to generate progressive award information. In one arrangement, the progressive server 132 may obtain information regarding amounts bet at specific gaming system devices 124, such as gaming machines 125 or table games 127. Utilizing this information, a progressive jackpot award amount may be generated and updated using a specified protocol. The information may be transmitted to one or more displays 134 associated with participating devices 124. Once again, a communication link is preferably provided between the progressive server 132 and each device with which communications is desired.

For example, a link may be provided between the progressive server 132 and accounting server 130 for providing payout information to the accounting server 130. The accounting server 130 also reads the paid amounts from the electronic gaming machines 125 as well and makes sure the paid amounts match what the progressive server claimed the paid amounts should have been. If the paid amounts don't match, then the accounting server 130 may raise a flag for further investigation by casino staff or regulators.

A virtual information host 136 is associated with or comprises a portion of the gaming system/environment 122. In one embodiment, the host 136 comprises a computing device, which includes a processor, memory and a display. The virtual information host 136 may be one or more devices separate from devices performing other functions of the system/environment 122, or may be integrated with existing devices. The virtual information host 136 may be designed and adapted to perform functions relating to acquiring, managing, rendering, generating and/or displaying real-time and/or non real-time casino gaming system or "gaming environment" graphical information and information regarding one or more components of the gaming system or environment. Such functionality may also include the generation of at least one graphical user interface on at least one mobile device (e.g., 131), which is configured or designed to graphically display information (e.g., real-time casino information) relating to selected aspects of casino activity. Also, different graphical user interfaces may be displayed on an external application, such as on an application of a computer, smart phone, and/or on any type of mobile device 131. In one embodiment, bi-directional communication channels 121 are provided for direct, two-way communication between the host 136 and at least one game server 126 and at least one player-tracking server 128, and/or any other device with which communications is desired.

As illustrated in the example of FIG. 1, gaming system/environment 122 may also include one or more mobile devices 131 configured or designed to communicate, via one or more wireless links 111, with various components of the gaming environment 100 such as, for example: information systems (e.g., virtual information host 136); player tracking systems; accounting systems; employee management systems; location positioning systems (e.g., GPS system 133); game servers; surveillance systems; security systems; communications systems; gaming systems (e.g., gaming machines 125, game table devices 127, other mobile devices 125, etc.); etc.

Figure 2:
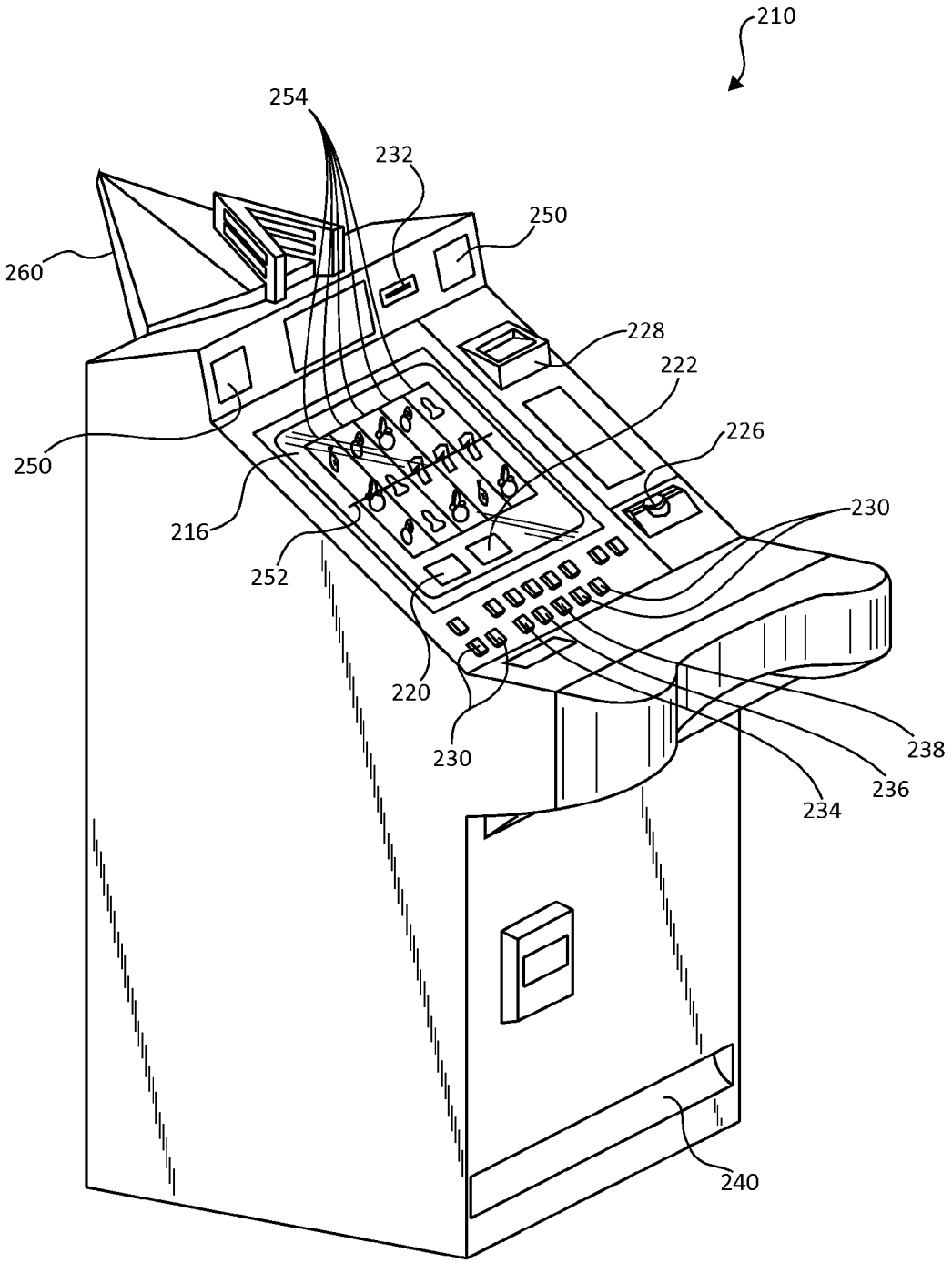
FIG. 2 is a perspective view of one embodiment of a slot machine or gaming device suitable for use in the gaming system of FIG. 1, in which aspects of the present invention may be realized.

FIG. 2 is a perspective view of one embodiment 210 of a slot machine or gaming device (e.g., an EGM) suitable for use in the previously depicted system of FIG. 1, in which aspects of the present invention may be realized. FIG. 2 represents a base gaming device 210 that can be employed in the shared display system or the gaming system of the present invention is illustrated as gaming device 210. FIG. 2 illustrates features common to each of the gaming devices. In one embodiment, EGM 210 has a support structure, housing or cabinet, which provides support for a plurality of displays, inputs, controls and other features of a conventional gaming machine. In the illustrated embodiment, the player plays gaming device 210 while sitting, however, the gaming device is alternatively configured so that a player can operate it while standing or sitting. The illustrated gaming device 210 is positioned on the floor but can be positioned alternatively (i) on a base or stand, (ii) as a pub-style table-top game (e.g., where the participant gaming devices are located remotely from the shared wheel as discussed below), (iii) as a stand-alone gaming device on the floor of a casino with other stand-alone gaming devices, which the player operates while standing or sitting (e.g., where the participant gaming devices are located remotely from the shared wheel as discussed below), or (iv) in any other suitable manner. The gaming device 210 can be constructed with varying cabinet and display configurations. Also, referring to an embodiment for the electronic configuration of gaming device 210, each gaming device may include the components described below in FIG. 3A and FIG. 3B.

In one embodiment, each gaming device 210 randomly generates awards and/or other game outcomes based on probability data. That is, each award or other game outcome is associated with a probability and each gaming device generates the award or other game outcome to be provided to the player based on the associated probabilities. Since each gaming device 210 generates outcomes randomly or based upon a probability calculation, there is no certainty that the gaming device 210 will provide the player with any specific award or other game outcome.

In another embodiment, as discussed in more detail below, each gaming device 210 employs a predetermined or finite set or pool of awards, progressive awards, prizes or other game outcomes. As each award or other game outcome is provided to the player, the gaming device 210 removes the provided award or other game outcome from the predetermined set or pool. Once removed from the set or pool, the specific provided award or other game outcome cannot be provided to the player again. The gaming device 210 provides players with all of the available awards or other game outcomes over the course of the play cycle and guarantees a designated amount of actual wins and losses.

Figure 3A:
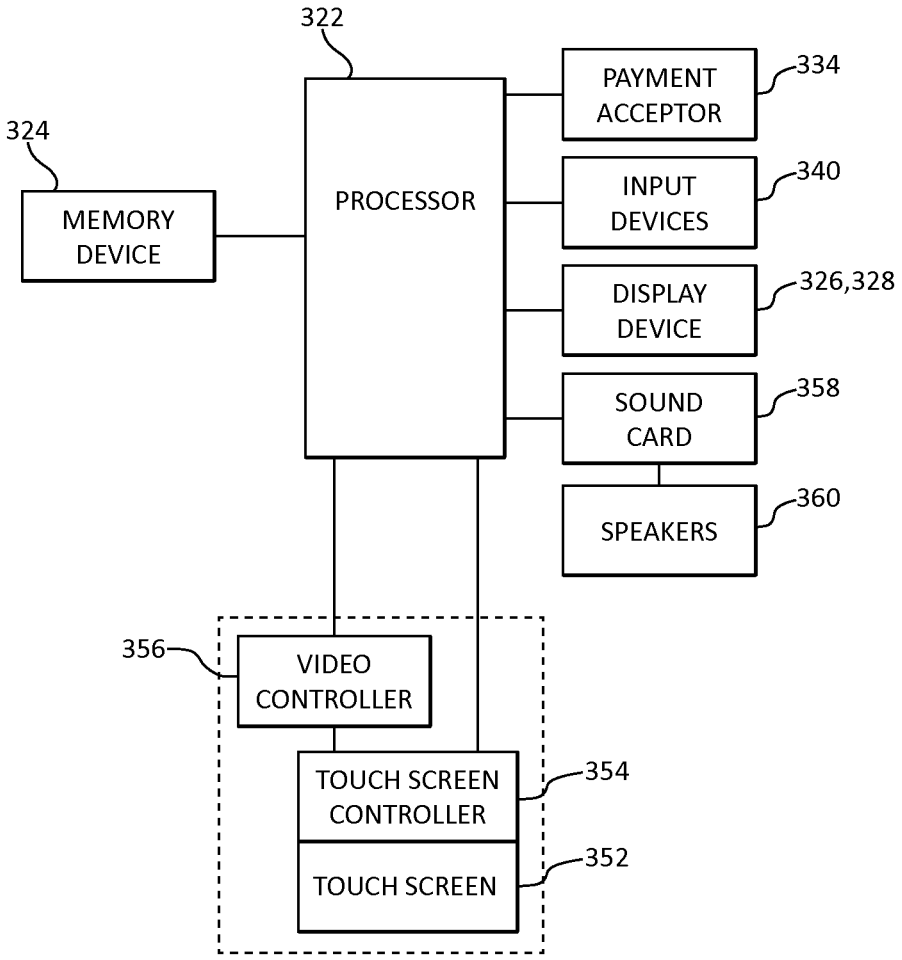
FIG. 3A is a block diagram illustrating an electronic configuration for use in the gaming device of FIG. 2, in which aspects of the present invention may be realized.

As seen in FIG. 2, the gaming device 210 includes a credit display 220 that displays a player's current number of credits, cash, account balance or the equivalent. In one embodiment, gaming device 210 includes a bet display 222 that displays a player's amount wagered. As illustrated in FIG. 3A, in one embodiment, each gaming device 210 includes at least one payment acceptor 334 (FIG. 3A) that communicates with processor 322 (FIG. 3A).

As seen in FIG. 2, the payment acceptor 334 (FIG. 3A) in one embodiment includes a coin slot 226, where the player inserts coins or tokens, and a ticket, note or bill acceptor 228, where the player inserts a bar-coded ticket, note, or cash. In one embodiment, a player-tracking card, credit card, debit card or data card reader/validator 232 is also provided for accepting any of those or other types of cards.

In one embodiment, a player inserts an identification card into card reader 232 of gaming device 210. The identification card can be a smart card having a programmed microchip or a magnetic strip coded with a player's identification, credit totals and other relevant information. In one embodiment, money may be transferred to gaming device 210 through an electronic fund transfer and card reader 232 using the player's credit, debit or smart card. When a player funds gaming device 210, processor 322 (FIG. 3A) determines the amount of funds entered and the corresponding amount is shown on the credit or other suitable display as described above. In one embodiment, after appropriate funding of gaming device 210, the player presses a play button 234 or pull arm (not illustrated) to start any primary game or sequence of events. In one embodiment, upon appropriate funding, gaming device 210 begins game play automatically. In another embodiment, the player needs to actuate or activate one of the play buttons to initiate play of gaming device 210.

As shown in FIG. 2, a bet one button 236 is provided. The player places a bet by pushing bet one button 236. The player increases the player's wager by one credit each time the player pushes bet one button 236. When the player pushes the bet one button 236, the number of credits shown in the credit display 220 decreases by one, and the number of credits shown in the bet display 222 increases by one. A max bet max button (not shown) may also be provided, which enables the player to bet the maximum wager (e.g., max lines and max wager per line). Gaming device 210 may include other suitable wager buttons 230, such as a max bet button, a repeat bet button, one or more select paylines buttons and one or more select wager per payline buttons.

In one embodiment, a cash out button 238 is provided. The player presses cash out button 238 and cashes out to receive a cash payment or other suitable form of payment corresponding to the number of remaining credits. The player can receive coins or tokens in a coin payout tray 240 or a ticket or credit slip, which are redeemable by a cashier or funded to the player's electronically recordable identification card. Each gaming device 210 also includes one or a plurality of communication ports for enabling communication of a processor with one or more external peripherals, such as external video sources, expansion buses, expansion games or other displays, an SCSI port or a key pad.

In one embodiment of FIG. 2, in combination with in FIG. 3A, a touch-screen 352 (FIG. 3A) is provided in one embodiment and operates with a touch-screen controller 354, processor 322 (FIG. 3A) and display device 326,328 (FIG. 3A). Touch-screen 352 (FIG. 3A) and the touch-screen controller 354 are also connected to a video controller 356. The player touches touch-screen 352 at appropriate places to input decisions and signals into processor 322 of gaming device 210. Also, each gaming device 210 may include a sound generating device controlled by one or more sounds cards 258, which function in conjunction with processor 322 (FIG. 3A). In one embodiment, the sound generating device includes at least one speaker 250 or other sound generating hardware and/or software for generating sounds, such as playing music for the primary and/or secondary game or for other modes of the gaming device, such as an attract mode. In one embodiment, each gaming device 210 provides dynamic sounds coupled with attractive multimedia images displayed on display device 216 to provide an audio-visual representation or to otherwise display full-motion video with sound to attract players to gaming device 210. During idle periods, the gaming device 210 displays a sequence of audio and/or visual attraction messages to attract potential players to gaming device 210. The videos in one embodiment are customized to provide information concerning the shared display of the present invention as discussed below.

In one embodiment, gaming device 210 includes a camera in communication with a processor, which is positioned to acquire an image of a player playing gaming device 10 and/or the surrounding area of gaming device 210. In one embodiment, the camera may be configured to selectively acquire still or moving (e.g., video) images and may be configured to acquire the images in either an analog, digital or other suitable format. Display device 216 may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, as illustrated in FIG. 2, a base or primary game includes a slot game with one or more paylines 252. Paylines 252 may be horizontal, vertical, circular, diagonal, angled or any combination thereof. For a slot game, gaming device 210 displays at least one reel and preferably a plurality of reels 254, such as three to five reels, in either electromechanical form with mechanical rotating reels or in video form with simulated reels and movement thereof. Each reel 254 displays a plurality of indicia such as bells, hearts, fruits, numbers, letters, bars or other images, which preferably correspond to a theme associated with the gaming device. With a slot game, gaming device 10 awards prizes when reels 254 stop spinning and display a winning or paying symbol or combination of symbols on an active payline 252.

In one embodiment, each gaming device 210 includes indicators 260. Indicators 260 reside on the top of each gaming device 10 and point to or indicate one of the awards or outcomes on top of shared display (not shown) when the shared display stops spinning to reveal randomly or otherwise generated results or outcomes. Indicators 260 may illuminate differently at different times or states for the gaming device 210. The illumination of the indicator 260 in one embodiment depends upon whether the gaming device 210 is playing a base game, is in a state in which the player is eligible to play the shared display bonus, is in a state in which the player has committed to play the shared display bonus or is in a state in which the player has declined to play a particular upcoming shared display bonus, as well as other states discussed below.

FIG. 3A is a block diagram illustrating an electronic configuration for use in the gaming device of FIG. 2, here again in which aspects of the present invention may be realized. In the embodiment illustrated in FIG. 3A the player station may include at least one processor 322, such as a microprocessor, a microcontroller-based platform, a suitable integrated circuit or one or more ASICs. The processor 322 is in communication with or operable to access or to exchange signals with at least one data storage or memory device 324. In one embodiment, the processor 322 and the memory device 324 reside within the cabinet of the player station. The memory device 324 stores program code and instructions, executable by the processor 322, to control the player station. The memory device 324 also stores other data such as image data, event data, player input data, random or pseudo-random number generators, pay-table data or information and applicable game rules that relate to the play of the player station. In one embodiment, the memory device 324 includes random access memory (RAM), which can include non-volatile RAM (NVRAM), magnetic RAM (MRAM), ferroelectric RAM (FeRAM) and other forms as commonly understood in the gaming industry. In one embodiment, the memory device 324 includes read only memory (ROM). In one embodiment, the memory device 324 includes flash memory and/or EEPROM. Any other suitable magnetic, optical and/or semiconductor memory may operate in conjunction with the player station and gaming system disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or the entire program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming system is operable over a wireless network, such as part of a wireless gaming system. In this embodiment, the player station may be a hand held device, a mobile device or any other suitable wireless device that enables a player to play any suitable game at a variety of different locations. It should be appreciated that a player station as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, a background play feature may be available where a player, who may be sitting at the lounge and/or at the bar with friends (at the casino), may be playing a machine from the floor by remote via the external application (e.g., a smart phone, an electronic tablet, a computer, and the like). The player may substitute into the same game he/she wanted from an online game (e.g., an IGT® online game) and play, or backend the actual game though a venue network. The game may be bankrolled by the venue the player was inside. If the player was to win the player could collect from that venue where the player was located, and/or instead of "reserving" a machine he could continue the game with an auto play during a period of time the player took a break/recess. In one embodiment, a team game may be played by a group of players (e.g., a group of 3 or 4 players) and the group of players may watch and/or play the same game on each players individual external device (e.g., a computer and/or smart phone). Similarly, as described above, the team game may be played by a group of players from a remote location (e.g., bar, lounge, casino, home, office, restaurant, etc.). In one embodiment, the team game may be played by a group of players and the group of players may share credit inputs and wins. In one embodiment, the team game may be played by the group of players and the group of players may sell off and/or share double up options and/or credits to others team players of the group.

In one embodiment, as discussed in more detail below, the gaming device randomly generates awards and/or other game outcomes based on probability data. In one such embodiment, this random determination is provided through utilization of a Random Number Generator (RNG), such as a true random number generator, a pseudo random number generator or other suitable randomization process. In one embodiment, each award or other game outcome is associated with a probability and the player station generates the award or other game outcome to be provided to the player based on the associated probabilities. In this embodiment, since the player station generates outcomes randomly or based upon one or more probability calculations, there is no certainty that the player station will ever provide the player with any specific award or other game outcome. In another embodiment, each award or other game outcome is associated with a probability and the central controller or server generates the award or other game outcome to be provided to the player based on the associated probabilities. In one embodiment, each of the player stations includes an RNG and the central server controls the display of the central display. It should be appreciated there may be one or more RNG's per: (a) display segment; (b) central display; (c) player station; (d) number of games; (e) the number of potential games; or (f) any combination of the above. It should also be appreciated that one or more processors may work together and communicate to accomplish any suitable function of the gaming system.

In another embodiment, the gaming system employs a predetermined or finite set or pool of awards or other game outcomes. In this embodiment, as each award or other game outcome is provided to the player, the central controller flags or removes the provided award or other game outcome from the predetermined set or pool. Once flagged or removed from the set or pool, the specific provided award or other game outcome from that specific pool cannot be provided to the player again. This type of gaming system provides players with all of the available awards or other game outcomes over the course of the play cycle and guarantees the amount of actual wins and losses.

In one embodiment, as mentioned above and seen in FIG. 3A, one input device is a touch-screen 352 coupled with a touch-screen controller 354, or some other touch-sensitive display overlay to allow for player interaction with the images on the display. The touch-screen and the touch-screen controller are connected to a video controller 356. A player can make decisions and input signals into the player station by touching the touch-screen at the appropriate places. One such input device is a conventional touch-screen button panel. In another embodiment, a plurality or each of the display segments is a touch-screen 352 coupled with a touch-screen controller 354 or some other touch-sensitive display overlay to allow for player interaction with the images on the display segments. The touch-screens 352 and the touch-screen controllers 354 are connected to a video controller. The player station may further include a plurality of communication ports for enabling communication of the processor with external peripherals, such as external video sources, expansion buses, game or other displays, an SCSI port or a key pad. In one embodiment, at least one payment acceptor 324 that communicates with processor 322 for playing a bet, input devices 340, and display devices 326,328 are provided.

The EGMs, the central controller, and the display segments may include serial interfaces and/or ethernet (e.g., G2S (game-to-system) protocol uses commodity Ethernet equipment and TCP/IP) to connect to specific subsystems or subnets internal and external to the player stations, central controller and the display segments. The serial devices may have electrical interface requirements that differ from the "standard" EIA serial interfaces provided by general-purpose computers. These interfaces may include EIA, EIA, Fiber Optic Serial, optically coupled serial interfaces, current loop style serial interfaces, etc. In addition, to conserve serial interfaces internally in the player station, serial devices may be connected in a shared, daisy-chain fashion where multiple peripheral devices are connected to a single serial channel.

The serial interfaces and/or ethernet may be used to transmit information using communication protocols that are unique to the gaming industry. For example, SAS is a communication protocol used to transmit information, such as metering information, from a player station to a remote device. Often SAS is used in conjunction with a player tracking system. EGM may be treated as peripheral devices to a casino communication controller and connected in a shared daisy chain fashion to a single serial interface and/or ethernet. In both cases, the peripheral devices are preferably assigned device addresses. If so, the serial controller circuitry must implement a method to generate or detect unique device addresses. In one embodiment, security-monitoring circuits detect intrusion into a player station or gaming station by monitoring security switches attached to access doors in a designated area, such as a player station cabinet. In one embodiment, access violations result in suspension of game play and can trigger additional security operations to preserve the current state of game play. These circuits also function when power is off by use of a battery backup.

In one embodiment, as seen in FIG. 3A, the player station includes a sound generating device controlled by one or more sounds cards 358 which function in conjunction with the processor. In one embodiment, the sound generating device includes at least one and preferably a plurality of speakers 360 or other sound generating hardware and/or software for generating sounds, such as playing music for the primary and/or secondary game or for other modes of the player station, such as an attract mode. In one embodiment, the player station provides dynamic sounds coupled with attractive multimedia images displayed on one or more of the display devices to provide an audio-visual representation or to otherwise display full-motion video with sound to attract players to the player station. During idle periods, the player station may display a sequence of audio and/or visual attraction messages to attract potential players to the player station. The videos may also be customized for or to provide any appropriate information.

In one embodiment, the gaming system may include a sensor, such as a camera in communication with the processor (and possibly controlled by the processor) that is selectively positioned to acquire an image of a player actively using the player station and/or the surrounding area of the player station. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia. In another embodiment, the gaming system includes a wireless transceiver or a camcorder and the display segments are components of or are connected to televisions, satellites, DVD players, digital video recorders and Internet-enabled devices. In one embodiment, the game may be displayed on the central display and replicated on one or more the player stations. In another embodiment, the game is only displayed on the central display and the player station is only used to input decisions or commands in the game. In another embodiment, a primary or base game is displayed on the player station and/or the central display and one or more bonus games are displayed on the central display only. In one embodiment, the player stations provide other information to a player, such as the win/loss history of that certain games or the win/loss history of that player. It should be appreciated that the central display and the player stations may work together with a central controller or a plurality of servers to provide the games to the player in any suitable manner.

Figure 3B:
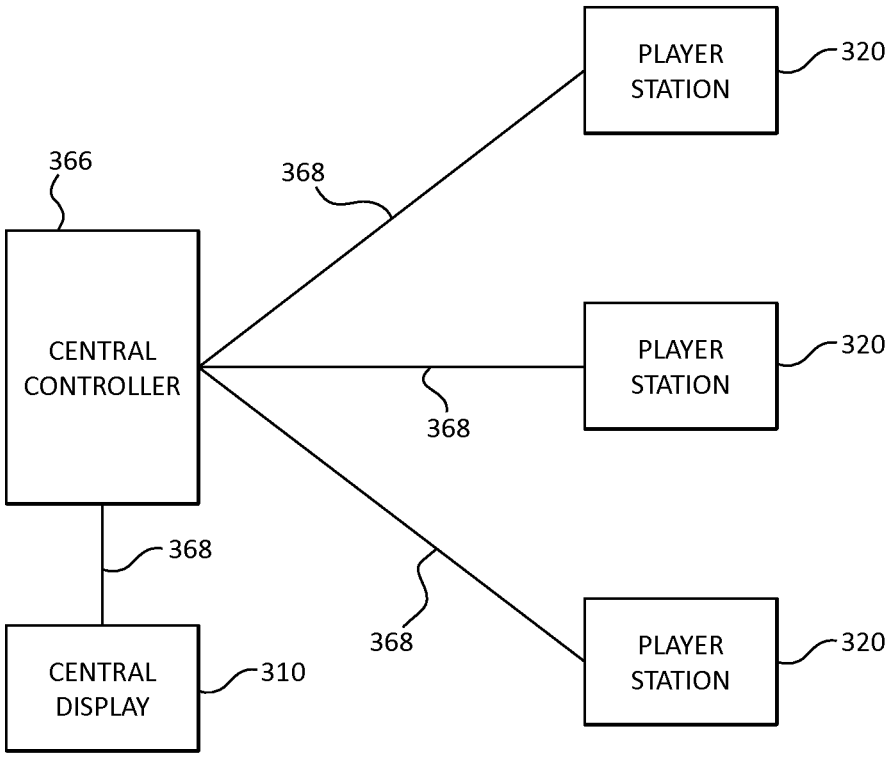
FIG. 3B is a block diagram illustrating player stations in communication with a central controller and a central display in communication with the central controller for use in the gaming device of FIG. 2, in which aspects of the present invention may be realized.

FIG. 3B is a block diagram illustrating a player station 320 in communication with a central controller and a central display 310 in communication with the central controller for use in the gaming device of FIG. 2, in which aspects of the present invention may be realized. In one embodiment, as illustrated in FIG. 3B, one or more of the player stations 320 are in communication with each other and/or at least one central server, central controller or remote host 366 through a data network or remote communication link 368. The central server, central controller or remote host is any suitable server or computing device, which includes at least one processor and at least one memory or storage device, and may also be in communication with a central display 310. In other embodiments, the central server is a progressive controller or a processor of one of the player stations in the gaming system. In these embodiments, the processor of each player station is configured to transmit and receive events, messages, commands, a current progressive value or any other suitable data or signal between the individual player station and the central server. The player station processor is operable to execute such communicated events, messages or commands in conjunction with the operation of the player station. Moreover, the processor of the central server is configured to transmit and receive events, messages, commands or any other suitable data or signal between the central server and each of the individual player stations. The central server processor is operable to execute such communicated events, messages or commands in conjunction with the operation of the central server. It should be appreciated that one or more of each of the functions of the central controller may be performed by one or more player station processors. It should be further appreciated that one, more or each of the functions of one or more player station processors as disclosed herein may be performed by the central controller. In one embodiment, the central controller has an Uninterruptible Power Supply ("UPS"). In one embodiment, the UPS is a rack mounted UPS module.

In one embodiment, the game outcome provided to the player is determined by a central server or controller and provided to the player at the player station. In this embodiment, each of the player stations is in communication with the central server or controller. Upon a player initiating game play at one of the player stations, the initiated player station communicates a game outcome request to the central server or controller. In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. The central server or controller is capable of storing and utilizing program code or other data similar to the processor and memory device of the player station. In an alternative embodiment, the central server or controller maintains one or more predetermined pools or sets of predetermined game outcomes. The central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes. The central server or controller communicates the generated or selected game outcome to the initiated player station. The player station receives the generated or selected game outcome and provides the game outcome to the player. In an alternative embodiment, how the generated or selected game outcome is to be presented or displayed to the player, such as a reel symbol combination of a player station or a hand of cards dealt in a card game, is also determined by the central server or controller and communicated to the initiated player station to be presented or displayed to the player. Central production or control can assist a gaming establishment or other entity in maintaining appropriate records, controlling gaming, reducing and preventing cheating or electronic or other errors, reducing or eliminating win-loss volatility.

In one embodiment, the player stations disclosed herein are associated with or otherwise integrated with one or more player tracking systems. In this embodiment, the player station and/or player tracking system tracks players gaming activity at the player station. In one such embodiment, the player station and/or associated player tracking system timely tracks when a player inserts their playing tracking card to begin a gaming session and also timely tracks when a player removes their player tracking card when concluding play for that gaming session. In another embodiment, rather than requiring a player to insert a player-tracking card, the player station utilizes one or more portable devices carried by a player, such as a cell phone, a radio frequency identification tag or any other suitable wireless device to track when a player begins and ends a gaming session. In another embodiment, the player station utilizes any suitable biometric technology or ticket technology to track when a player begins and ends a gaming session. During one or more gaming sessions, the player station and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. The player stations are capable of being connected together through a data network. In one embodiment, the data network is a local area network (LAN), in which one or more of the player stations are substantially proximate to each other and an on-site central server or controller as in, for example, a gaming establishment or a portion of a gaming establishment. In another embodiment, the data network is a wide area network (WAN) in which one or more of the player stations are in communication with at least one off-site central server or controller. The player stations may be located in a different part of the gaming establishment or within a different gaming establishment than the off-site central server or controller. Thus, the WAN may include an off-site central server or controller and an off-site player station located within gaming establishments in the same geographic area, such as a city or state. The WAN gaming system may be substantially identical to the LAN gaming system described above, although the number of player stations in each system may vary relative to each other.

In one embodiment, as a benefit to one or more of the gaming venues (e.g., a casino), using the player tracking system, along with use of the GPS positioning, for identifying the movements of the players throughout the gaming venues, identifying cash, money, credits, and award amounts spent along with various trends (e.g., historical) for generating visual graphs while displaying showing top view of the gaming venue (e.g., looking down from above the gaming venue) to improve casino layouts and identify patterns an movements of all types of players.

In another embodiment, the data network is an Internet or intranet. The operation of the player station can be viewed at the player station with at least one Internet browser. Operation of the player station and accumulation of credits may be accomplished with only a connection to the central server or controller (the internet/intranet server) through a conventional phone or other data transmission line, digital subscriber line (DSL), T-1 line, coaxial cable, fiber optic cable, WIFI, or other suitable connection. Players may access an Internet game page from any location where an Internet connection and computer, or other Internet facilitator is available. The expansion in the number of computers and number and speed of Internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, as described above, the gaming system is in communication with a central server or controller. The central server or controller may be any suitable server or computing device, which includes at least one processor and a memory or storage device. In alternative embodiments, the central server is a progressive controller or another player station in the gaming system. In one embodiment, the memory device stores different game programs and instructions, executable by a player station processor, to control the player station. Each executable game program represents a different game or type of game, which may be played on one or more of the player stations in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the player station) or vice versa.

In this embodiment, one, all or a plurality of the player stations at least includes one or more display devices and/or one or more input devices for interaction with a player. A local processor, such as the above-described player station processor or a processor of a local server, is operable with the display device(s) and/or the input device(s) of one or more of the player stations. In operation, the central controller is operable to communicate one or more of the stored game programs to at least one local processor. In different embodiments, the stored game programs are communicated or delivered by embedding the communicated game program in a device or a component (e.g., a "chip" to be inserted in a player station), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the player station. That is, when a game program is communicated to a local processor, the local processor changes the game or type of game played at the player station or displayed on the display segment. Though the illustrated embodiments are described with the central controller determining a game result for the player and communicating that result to the central display 310 and one or more player stations, any other suitable game determining method may be employed in any embodiment of the present disclosure. In one embodiment, the central display 310 is associated with a central display 310 server. This central display 310 server determines the game outcome for the games played on each of the display segments. The central display 310 server communicates the game outcome to the central controller, which communicates the game outcome to one or more of the player stations.

In one embodiment, the central controller determines the award to provide to the player based on the game outcome. In another embodiment, the player stations determine the award and/or progress jackpot/value to provide to the players based on the game outcomes. In another embodiment, the central controller determines the game outcome displayed on the central display 310 and the player station determines any award and/or progress jackpot/value to provide to the player based on the game outcome. The player station determines both the game outcome and any award to provide to the player based on the game out come. In another embodiment, the central controller determines part of the outcome and the player station determines part of the outcome. That is, both the central controller and the player station determine part of a player's outcome and/or award.

Further, in the gaming industry, many different manufacturers make gaming machines and player stations. The communication protocols on the player station may be hard-wired into the player station and each player station/gaming machine manufacturer may utilize a different proprietary communication protocol. A player station manufacturer may also produce host systems, in which case their player stations are compatible with their own host systems. However, in a heterogeneous gaming environment, player stations from different manufacturers, each with its own communication protocol, may be connected to host systems from other manufacturers, each with another communication protocol. Therefore, communication compatibility issues regarding the protocols used by the player stations in the system and protocols used by the host systems must be considered.

In another embodiment, player stations at one or more gaming sites may be networked to a central server in a progressive configuration, wherein a portion of each wager to initiate a base or primary game may be allocated to bonus or secondary event awards. In one embodiment, a host site computer is coupled to central servers at a variety of mutually remote gaming sites for providing a multi-site linked progressive automated gaming system. The host site computer may serve player stations distributed throughout a number of properties at different geographical locations including, for example, different locations within a city or different cities within a state. The host site computer may be maintained for the overall operation and control of the system. A host site computer may oversees the entire progressive gaming system and may be the master for computing all progressive jackpots and values for each and every gaming device. All participating gaming sites report to, and receive information from, the host site computer. Each central server computer may be responsible for all data communication between the player station hardware and software and the host site computer. An individual player station may trigger a progressive win, for example through a game play event such as a symbol-driven trigger in the multi-component game. The central server or other central controller determines when a progressive win is triggered. The central controller and an individual player station may work in conjunction with each other to determine when a progressive win is triggered, for example through an individual player station meeting a predetermined requirement established by the central controller. The progressive award win may be triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a player station is randomly or apparently randomly selected to provide a player of that player station one or more progressive awards. In one such embodiment, the player station does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game. In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards).

In one such embodiment, the greater the players' wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner. In another embodiment, one or more of the progressive awards are partially funded via a side-bet or side-wager, which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In one alternative embodiment, a minimum wager level is required for a player station to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, players at a linked player stations in a gaming system participate in a group gaming environment. In one embodiment, players at linked player stations work in conjunction with one another, such as playing together as a team or group, to win one or more awards. In one such embodiment, any award won by the group is shared, either equally or based on any suitable criteria, amongst the different players of the group. In another embodiment, players linked player stations compete against one another for one or more awards. In one such embodiment, players at linked player stations participate in a gaming tournament for one or more awards. In another embodiment, players at linked player stations play for one or more awards wherein an outcome generated by one player station affects the outcomes generated by one or more linked player stations.

FIGS. 4, 5, 6, 7 and 8 illustrate views of a service based gaming system in which SOAP is used, according to embodiments of the present inventions. SOAP is the successor of XML-RPC. SOAP originally stood for Simple Object Access Protocol, and lately also Service Oriented Architecture Protocol, but is now simply SOAP. The SOAP specification is currently maintained by the XML Protocol Working Group of the World Wide Web Consortium. SOAP is encapsulated in the Microsoft WCF—Windows Communication Foundation available in ".NET Framework 3.0" and later versions. According to embodiments of the present inventions, abstract layers may be built on SOAP for providing a service oriented architecture (SOA) such as a publish-and-subscribe message bus. A bus, according to embodiments of the present inventions, may then be thought of as a service messaging engine based on, for example, standards such as SOAP, RPC, Microsoft Remoting, CORBA, RSS and/or Microsoft WCF (Windows Communication Foundation of .NET Framework 3.0). In FIGS. 4, 5, 6, 7 and 8, a node may be or include a computer, personal digital assistant, cell phone, router, switch, hub, and server, workstation, handheld PC, gaining machine, specialized device, an ATM or other device or process having the requisite processing functionality.

Figure 4:
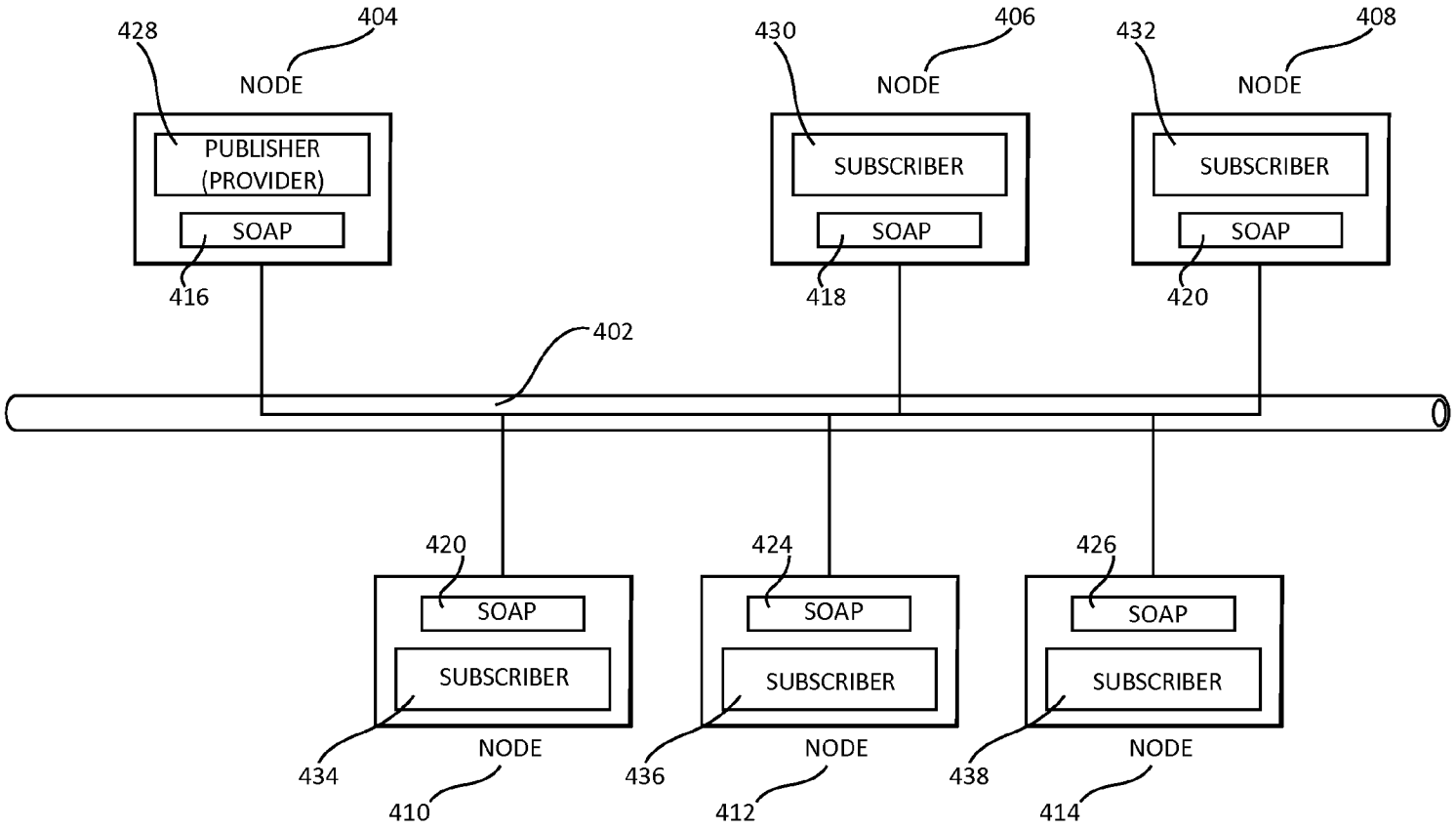
FIG. 4 is a service based gaming system including nodes arranged such as to offer one service publisher and multiple service subscribers in which aspects of the present invention may be realized.

FIG. 4 illustrates a view of the service based gaming system according to an embodiment of the present inventions including multiple nodes 404, 406, 408, 410, 412 and 414 arranged such as to offer one service publisher 428 and multiple service subscribers 430, 432, 434, 436 and 438. The network 402 is representative of a physical communication medium that may be loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 416, 418, 420, 422,424 and 426 may be included in each node to allow the communication of services. The publisher/publisher (the two terms being synonymous) 428 may publish (or provide) services that one or more subscribers (or consumers) may consume, over the network 402. The services provided by the publishing node 404/428 may be (a) high level functions such as from a business application server, a bonusing server, a customer loyalty server, a progressive jackpot server and a player tracking server, or (b) services from a specialized device, e.g. a network connected printer, a network connected bill acceptor, a player tracking combo (video display+touch-screen+card reader) and devices connected to a network bridge USB to Ethernet or RS232 to Ethernet. The services provided by the publishing node 404/428 may be consumed independently by multiple subscribing nodes 406/430, 408/432, 410/434, 412/436 and/or 414/438.

Figure 5:
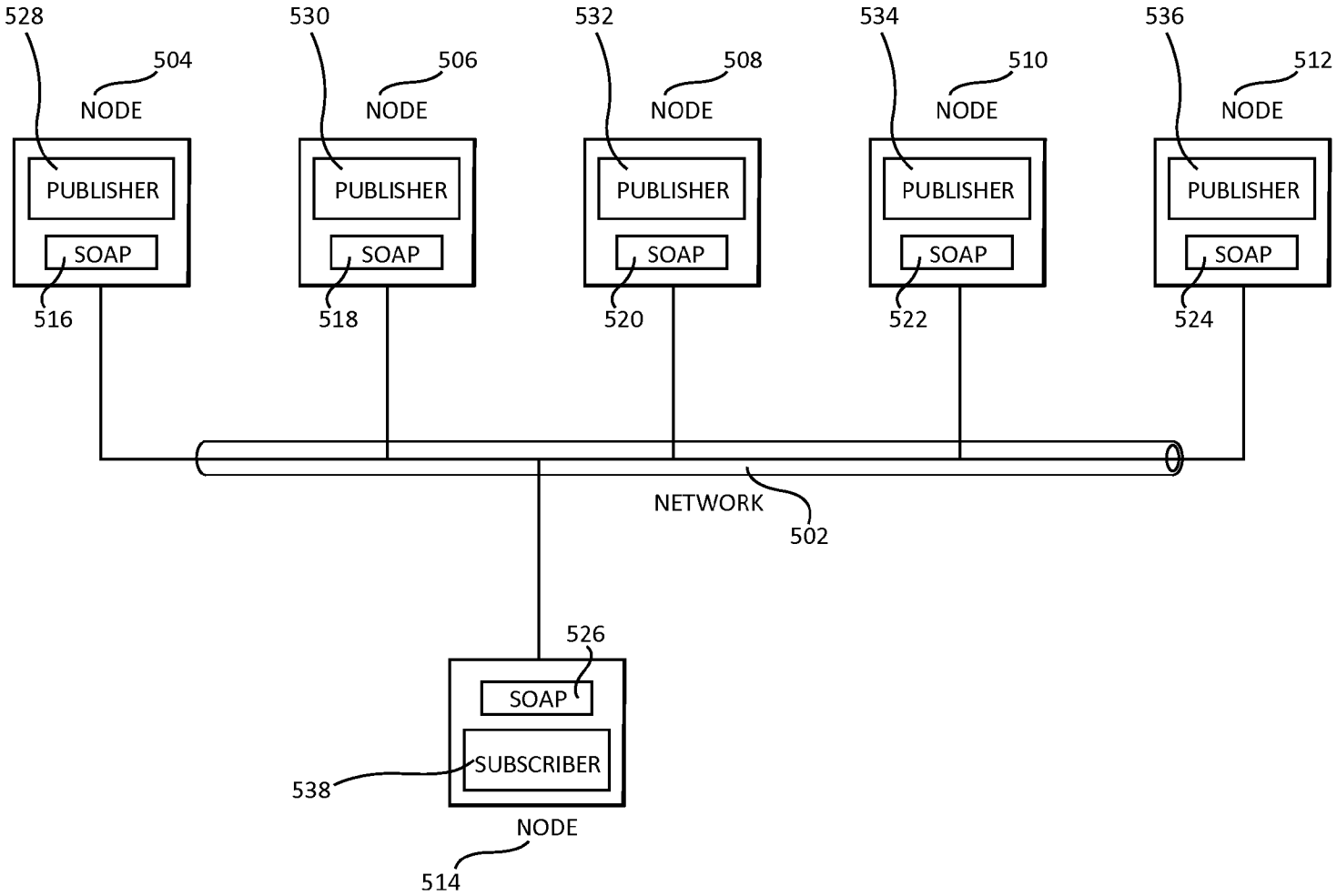
FIG. 5 is a service based gaming system including nodes arranged such as to offer multiple service publishers and one service subscriber in which aspects of the present invention may be realized.

FIG. 5 illustrates a view of a service based gaming system, according to an embodiment of the present inventions. As shown, the service based gaming system may include multiple nodes 504, 506, 508, 510, 512 and 514 arranged such as to offer multiple service publishers 528, 530, 532, 534 and 536 and one service subscriber 538. The network 502 is representative of a physical communication medium that may be a loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 516, 518, 520, 522, 524 and 526 may be included in each node to allow the communication of services. The services provided by the publishing node 504/528, 506/530, 508/532, 510/534 and/or 512/536 may be (a) high level functions such as from a business application server, a bonusing server, a customer loyalty server, a progressive jackpot server and a player tracking server, or (b) services from a specialized device, e.g. a network connected printer, a network connected bill acceptor, a player tracking combo (video display+touch-screen+card reader) and devices connected to a network bridge USB to Ethernet or RS232 to Ethernet. The services provided by the publishing nodes 504/528, 506/530, 508/532, 510/534 and 512/536 may be consumed independently by one subscribing node 514/538; for example, network connected printers installed in gaming machines may publish a range of services and a maintenance server may subscribe to, e.g., a paper jam alert and the paper low alert services such that the maintenance server may forward a job order to a technician on his or her mobile device.

Figure 6:
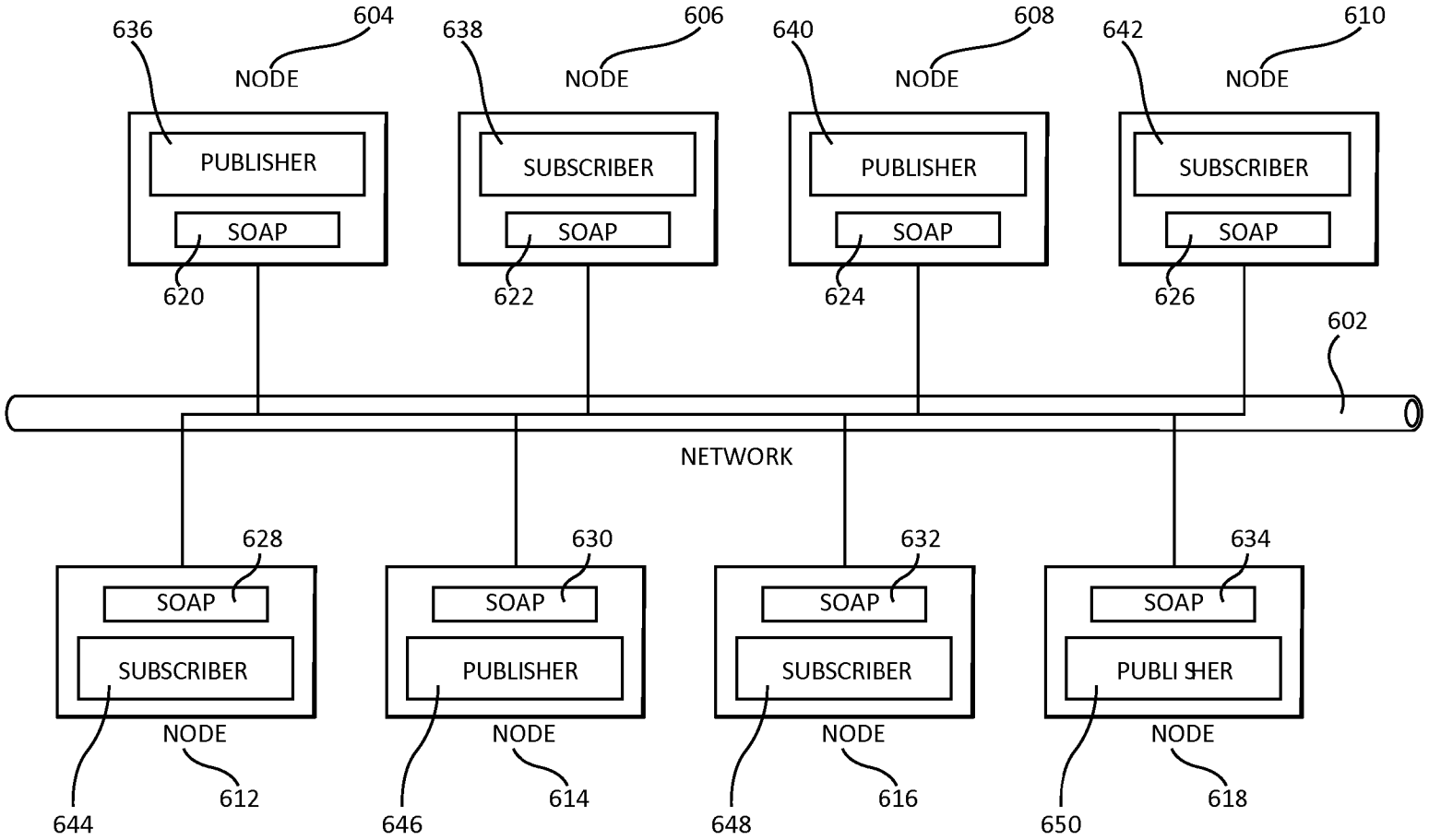
FIG. 6 is a service based gaming system including nodes arranged such as to offer multiple service publishers and multiple service subscribers in which aspects of the present invention may be realized.

FIG. 6 illustrates a view of a service based gaming system according to another embodiment of the present invention that may include a plurality of nodes 604, 606, 608, 610, 612, 614, 616 and 618 arranged such as to offer multiple service publishers 636, 640, 646 and 650 and multiple service subscribers 638, 642, 644 and 648. The network 602 may be representative of a physical communication medium that may be a loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 620, 622, 624, 626, 628, 630, 632 and 634 may be included in each node to allow the communication of services.

Figure 7:
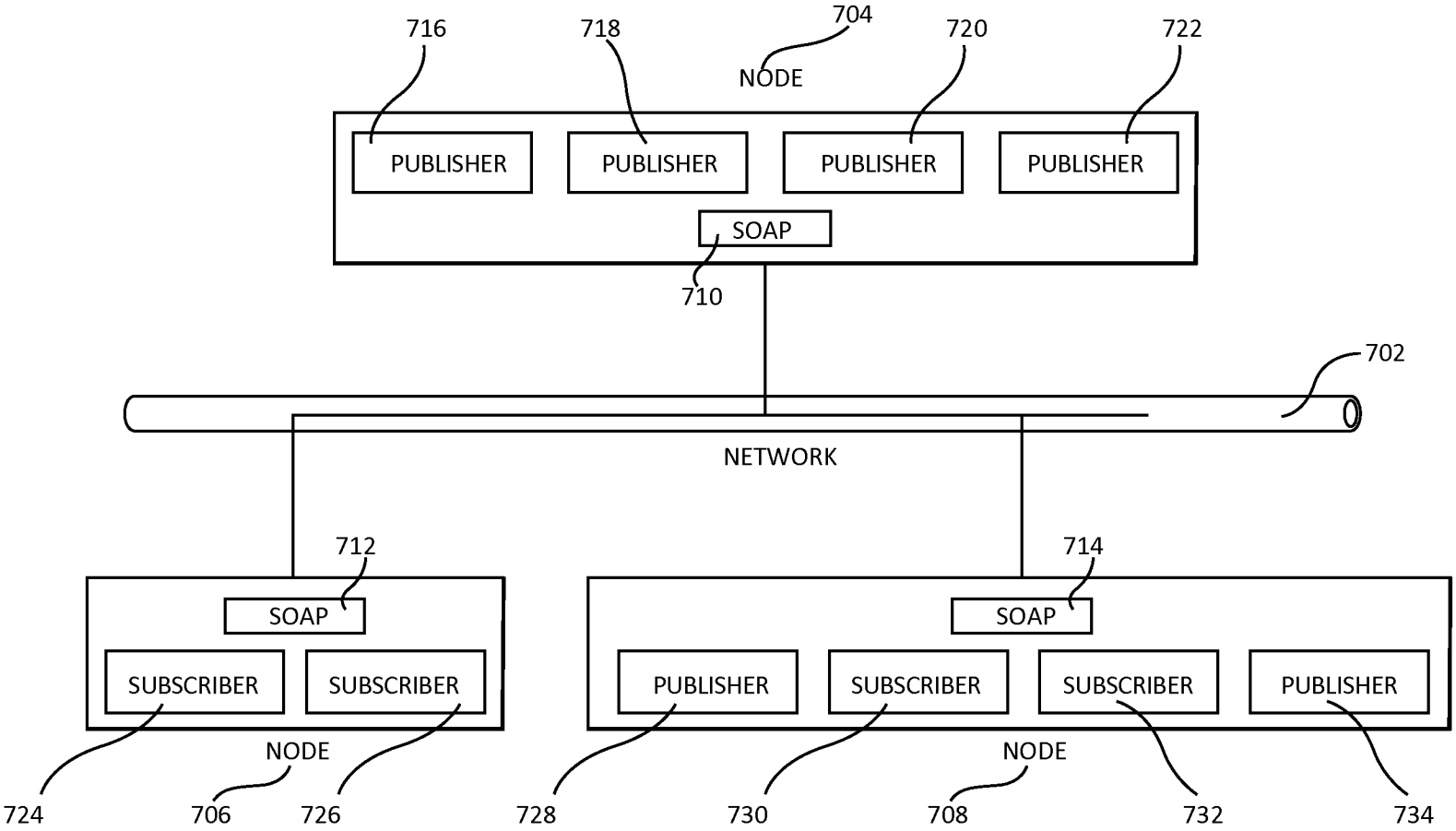
FIG. 7 is a service based gaming system including nodes with each node arranged such as to offer a one service publisher, multiple service publishers, one service subscriber and/or multiple service subscribers in which aspects of the present invention may be realized.

FIG. 7 illustrates a view of a service based gaming system according to an embodiment of the present invention. As shown, the service based gaming system of FIG. 7 may include a plurality of nodes 704, 706 and 708, wherein each node is arranged such as to offer one or more of: one service publisher, multiple service publisher's, one service subscriber and multiple service subscribers. The network 702 is representative of a physical communication medium that may be a loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 710, 712 and 714 may be included in each node to allow the communication of services. For example, node 704 may include a central media server that may be configured to publish (provide), for example, music content 716, advertising video content 718, promotional video content 720 and a live TV feed 722 to authorized participating nodes in the distributed gaming system. Node 706 may include, for example, a billboard in a bar section wherein one network connected streaming plasma display 724 may subscribe to the live video TV feed 722 and the network connected ambience audio system may subscribe to the music content 716. Node 708 may include, for example, a gaming machine wherein an instance of a media player process 730 may subscribe to the live video TV feed 722 and another instance of a media player process 732 may subscribe to the advertising video content 718, and the video contents may be displayed simultaneously on the video gaining display or displays through a separate video window or 3D viewport. The gaming machine (node) 708 may publish 728 its gaining meters using the GSA G2S protocol (Game Standard Association Game-to-System protocol), and any authorized node may subscribe to receive the gaming meters such as a casino management system (whose primary function is to satisfy regulatory accounting), a game download server, a security server, a marketing server, a player tacking server and/or a maintenance server, for example.

Figure 8:
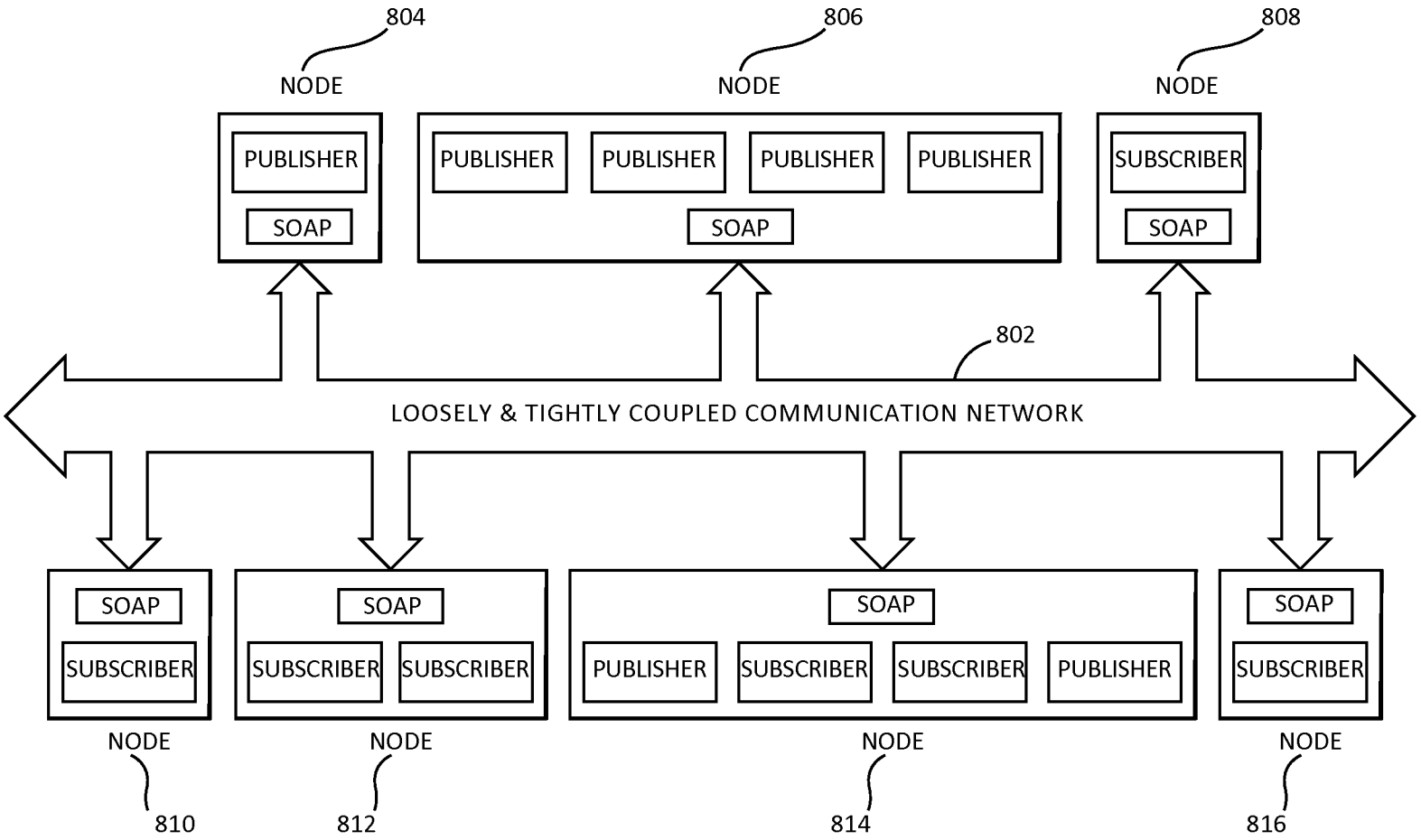
FIG. 8 is a service based gaming system including nodes with each node arranged such as to offer one service publisher, multiple service publishers, one service subscriber and/or multiple service subscribers with a communication network pictured as a service bus that may include loosely coupled and/or tightly coupled nodes in which aspects of the present invention may be realized.

FIG. 8 illustrates a view of the service based gaming system according to an embodiment of the present invention. As shown, the present service based gaming system may one or more nodes, and each node may be arranged such as to offer one or more of the following: (a) one service publisher, (b) multiple service publishers, (c) one service subscriber and (d) multiple service subscribers. The communication network labeled "network bus" 802 may include loosely coupled and tightly coupled nodes carrying network services via the SOAP stack. Node 804 may include, for example, a USB printer specialized device located within an ATM for publishing printing services in the ATM. Node 808 may include, for example, a technician Wi-Fi handheld mobile device subscribing to alerts to repair jammed printers or bill acceptors.

Node 810 may include, for example, a billboard subscribing to a Keno server (not shown) that displays the published results of that Keno server.

In the illustrations of FIGS. 4, 5, 6, 7 and 8, the service discovery is not shown but may include any service discovery protocol as discussed previously, such as UDDI and SSDP. UDDI (Universal Description, Discovery and Integration) is a platform-independent, XML-based registry for businesses worldwide to list themselves on the Internet. UDDI is an open industry initiative, enabling businesses to publish service listings and discover each, other and define how the services or software applications interact over the Internet. UDDI may also be applied in an Intranet network. SSDP (Simple Service Discovery Protocol) is the basis of the discovery protocol of Universal plug-and-play. SSDP provides a mechanism through which network clients can use to discover network services. Clients can use SSDP with little or no static configuration. SSDP provides multicast discovery support, server-based notification, and discovery routing. SSDP uses XML UDP unicast and multicast packets to advertise their services. Nodes may be added and removed to the network; new services will be discovered and bound automatically, and services that are no longer available will be detected and their associated binding will be terminated. Nodes may be provided by any supplier complying with the service bus protocol. In the figures, the SOAP stack is the network service, but as may be readily inferred by persons of skill in the distributed network architecture arts, any other network service stack offering similar capability may be used, including the associated service discovery scheme.

Figure 9:
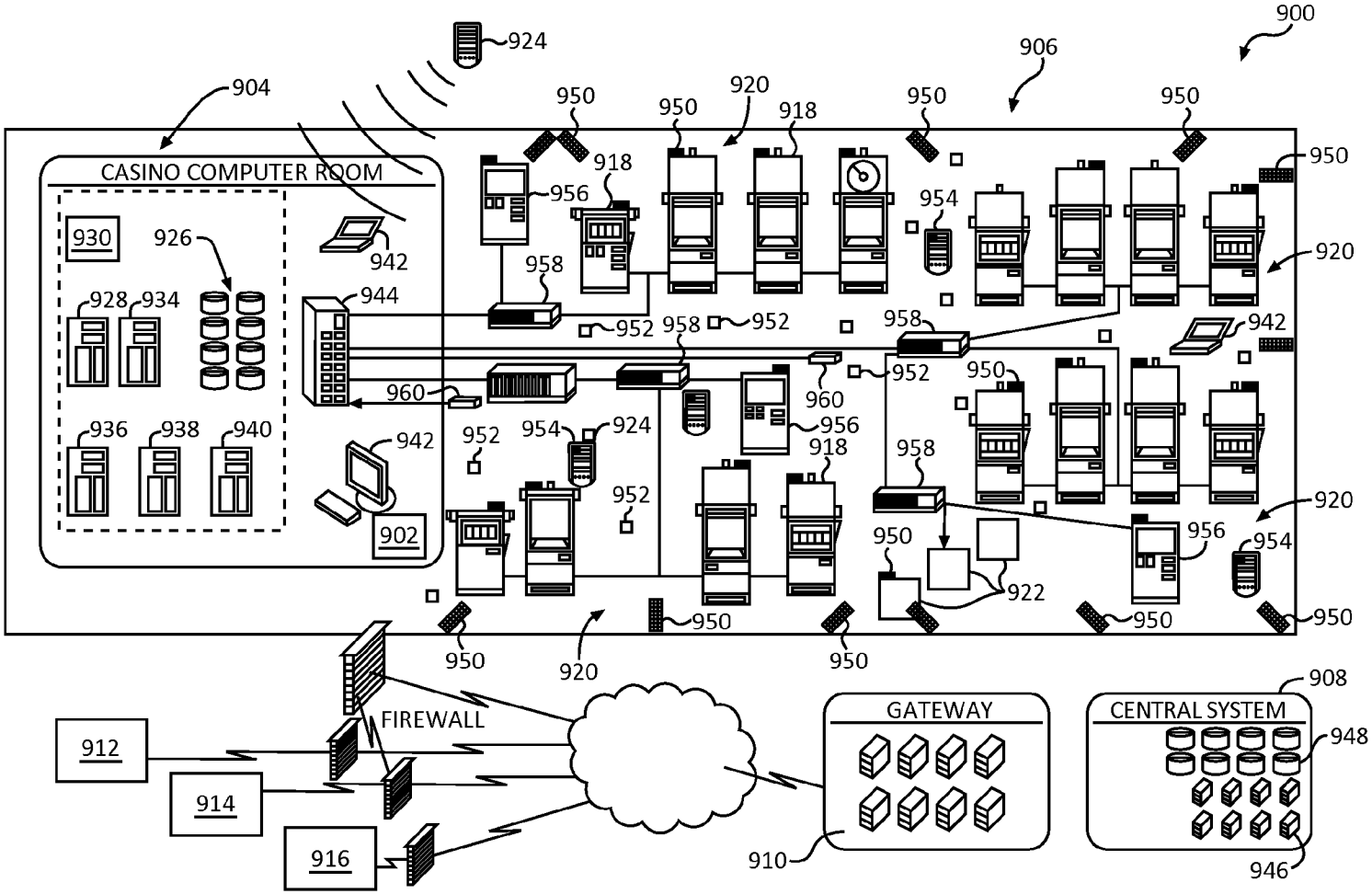
FIG. 9 is a schematic block diagram of a server-based gaming network in which aspects of the present invention may be realized.

FIG. 9 is a schematic block diagram of a server-based gaming network 900 in accordance with an exemplary embodiment of the present invention. In the exemplary embodiment, network 900 includes a slot floor mix recommendation system 902 incorporated therein. In one embodiment, slot floor mix recommendation system 902 is a stand alone system communicatively coupled to network 900. In various embodiments, slot floor mix recommendation system 902 is incorporated within various components of network 900. Network 900 provides methods and devices for managing one or more networked gaming establishments. Network 900 may be embodied in what is known as a server-based gaming network, sbX™ network. For example, the IGT® sbX™ gaming management solution is a server-based system to house all game content in the EGM, giving each terminal instant access to the technology within the EGMs environment. In one embodiment, a host may monitor the monetary activity of the EGM. The host may track any error conditions on the EGM. The host can configure the EGM such as to enable/disable games, download games, configure game parameters (denomination, payback, etc.). For example, in one embodiment, the host may be included in a network, such as a server-based gaming network. For example, a gaming server (e.g., an sbX™ server) may be an example of the host. The gaming server (e.g., the sbX™ server) may be a set of servers running central applications and may attach as the host to EGMs via the gaming network. For example, the host may be the sbX™ server managing and controlling the gaming network (e.g., an sbX™ network). For example, a gaming management solution (e.g., IGT® sbX™ gaming management solution) may be a server-based system to act as a repository for all game content that may be downloaded to EGMs, giving each EGM instant access to the technology within the EGM's environment. The game software, random number generator and game logic are controlled by the EGM. This significantly increases configuration speed so that games may be adapted and seamlessly integrate analytics to the database in minutes. Game titles are accessed from the server using a floor manager (e.g., IGT Floor Manager®), running on the host, and allow operators to reconfigure their gaming floor almost instantly. In one embodiment, a floor manager, running on the host, is a G2S-compliant game-to-system management solution that enables operators to remotely change the game mix on the casino floor. In one embodiment, the floor manager application provides operators with sophisticated and user-friendly visualization tools to analyze terminal (e.g., the EGM) and game performance in real-time. Using Quick Change functionality (QCF), the floor manager, running on the host server(s), enables operators to rapidly locate low performing games, select a new theme from the game library and download the new theme on the EGM in the gaming venue floor within minutes. The software displays a map of the casino floor and highlights EGMs color-coded to indicate performance. Operators can select individual terminals and receive analysis at terminal-, multi-game and single-game level, based on KPIs such as coin-in, actual win and occupancy of game. In one embodiment, the floor manager application is a gateway to a game-to-system library allowing operators to quickly schedule changes or switch between themes. Once selected, the game's configurations can be set including denomination, max bet and even volume and credit limits on the EGM. For example, new gaming industry-leading themes may be added to the game library every month and the floor manager application provides rapid deployment to the gaming floor to ensures an EGM will maintain high performance and continually provide the user with newer and advanced games to add to the users favorite and/or preferred games. In one embodiment, the quick recognition and eradication of low performing games and ability to respond to consumer requests on the floor, empowers a gaming venue to concentrate on player satisfaction and gaming experience.

In addition, with the sbX™ gaming management, as each EGM connected to the system is self-sufficient, if there is a malfunction or connectivity fault, information is backed up at the individual EGM for a predetermined period of time (e.g., two weeks), ensuring no data loss. Once the problem is resolved and the EGM is re-connected to a server, the backed-up data is instantly dropped into the database. Operators now have the ability to run their own choice of games on any interconnected terminal in the gaming venue. This allows management to switch between games at any time, delivering an unmatched level of flexibility and control over their gaming environment. Users are also able to select the games (e.g., a favorite and/or preferred EGM) and denominations they wish to play at the terminal. In one embodiment, the sbX™ gaming management system delivers a flexible and diversified approach to management and control of the casino floor, reconfiguring gaming machines at the appropriate time and schedule. For example, in one embodiment, all EGMs connected to the server are granted full access to themes held in a games depository and operators can reconfigure each terminal remotely from the workstation. A Games Library may be included and may contain over 300 gaming titles in a game-to-system depository. In one embodiment, the sbX™ gaming management application allows for games to be updated in minutes and with this simple configuration process in place, operators can place better focus on in-depth player statistics. Accurate information in real-time optimizes marketing strategies, to provide the ultimate gaming experience and ensure the floor remains dynamic. Instantaneous analysis and decisions may be implemented to adjust elements and increase user satisfaction and loyalty. This also enables a gaming venue to ensure users are able to play the latest content available. Various game themes can be changed, tested and reverted in different areas of the gaming venue with rapid execution. In one embodiment, the sbX™ application and its integrated modules provide for data analysis and also focus on player experience thereby allowing for the development of innovative marketing programs. For example, in one embodiment, certain banks of machines may be adapted to a featured game, linked to a proprietary progressive jackpot and then heavily promoted during certain times. Thus, these games may become a favorite and preferred EGM during a particular time. Following the promotion, the EGMs can quickly be restored to their original games. In one embodiment, the sbX™ system may be driven by IGT's Advanced Video Platform (AVP®) with the technology seamlessly integrated with all modules, permitting fast connectivity and advanced capabilities. In addition, GSA open protocols are used so that sbX™ applications are interoperable with third-party devices that have also adopted GSA open protocols.

Thus, in one embodiment, if a demand for a particular type of the EGM is in high demand (e.g., multiple users are selecting a favorite and/or preferred game on a particular EGM) but the supply of the favorite and/or preferred game on a particular EGM is low, the floor manager application provides the ability to quickly (e.g., within minutes) update and replace the EGMs having low performing games and/or non-preferred games on the EGM with the higher performing and/or favorite and preferred game on a particular EGM. In one embodiment, if a user selects a favorite and/or preferred game on a particular EGM and the favorite and/or preferred game on a particular EGM is unavailable and/or occupied, a notification maybe sent to the floor manager allowing the floor manager the opportunity to update and/or replace another EGM with the user's favorite and/or preferred game on an alternative EGM. The floor manager then may send a notification back to the user that the favorite and/or preferred game on the alternative EGM is available for play and use, while the original favorite and preferred game on the preferred EGM waits to become available and/or unoccupied for use.

In one embodiment, network 900 permits the convenient provisioning of networked gaming machines and other devices relevant to casino operations. Game themes may be easily and conveniently added or changed, if desired. Related software, including but not limited to player tracking software and/or peripheral software may be downloaded to networked gaming machines, mobile gaming devices, thin clients and/or other devices, such as kiosks, networked gaming tables, player stations.

In some implementations, servers or other devices of a central system will determine game outcomes and/or provide other wager gaming functionality. In some such implementations, wagering games may be executed primarily on one or more devices of a central system, such as a server, a host computer, etc. For example, wager gaming determinations such as interim and final game outcomes, and bonuses may be made by one or more servers or other networked devices. Player tracking functions, accounting functions and some display-related functions associated with wagering games may be performed, at least in part, by one or more devices of a casino network and/or of a central system.

In the exemplary embodiment, network 900 includes a casino computer room 904 and networked devices of a gaming establishment 906. Gaming establishment 906 is configured for communication with a central system 908 via a gateway 910. Other gaming establishments 912, 914, and 916 are also configured for communication with central system 908.

Gaming establishment 906 includes multiple gaming machines 918. Some of gaming machines 918 form a cluster or "bank" 920 of gaming machines 918. Gaming machines 918 are configured for communication with one or more devices of casino computer room 904 or similar devices disposed elsewhere in gaming establishment 906. Some of gaming machines 918 may be configured to read from, and/or write information to, a portable instrument such as but not limited to, a ticket and a player loyalty device. In the exemplary embodiment, gaming establishment 906 also includes a bank of networked gaming tables 922. However, network 900 may be implemented in gaming establishments having any number of gaming machines, gaming tables, etc. It will be appreciated that many gaming establishments 906 include hundreds or even thousands of gaming machines 918 (e.g., EGMs), gaming tables 922 and/or mobile devices 924, not all of which are necessarily associated bank 920 and some of which may not be connected to network 900. At least some of gaming machines 918 and/or mobile devices 924 may be "thin clients" that are configured to operate, at least in part, according to instructions from another device (such as a server).

Multiple storage devices 926, sbX™ server 928, License Manager 930, servers 934, 936, 938, and 940, host device(s) 942, and main network device 944 are disposed within computer room 904 of gaming establishment 906. In practice, more or fewer devices may be used. Depending on the implementation, some such devices may reside elsewhere in gaming establishment 906.

One or more of the devices in computer room 904 (or similar devices disposed elsewhere in gaming establishment 906 or in gaming establishment 912, 914, or 916) may be configured to provide functionality relevant to embodiments of the present invention. For example, one or more of servers 934, 936, 938, or 940 may be configured for communication with gaming machines 918 that are configured to provide a subset of themes for selection by a player. For example, one or more such servers may be configured to provide a selection of a subset of four themes (and/or some other number of gaming themes) from a large number of available gaming themes.

Accordingly, in some embodiments at least some gaming establishments may be configured for communication with one another (e.g., other gaming establishments). In this example, gaming establishments 912, 914, and 916 are configured for communication with casino computer room 904. Such a configuration may allow devices and/or operators in gaming venue/casino 906 to communicate with and/or control devices in other casinos. In some such implementations, a server (or another device) in computer room 904 may be configured to communicate with and/or control devices in gaming establishments 912, 914, and 916. Conversely, devices and/or operators in another gaming establishment may communicate with and/or control devices in casino 906.

Some of these servers in computer room 904 may be configured to perform tasks relating to accounting, player loyalty, bonusing/progressives, configuration of gaming machines, etc. A Radius server and/or a DHCP server may also be configured for communication with the gaming network. In various embodiments, sbX™ server 928 and the other servers shown in FIG. 9 include or are in communication with clustered CPUs, redundant storage devices, including backup storage devices, switches, etc. Such storage devices may include a redundant array of independent disks (RAID) array, back-up hard drives and/or tape drives, etc.

In various embodiments, many of these devices (including but not limited to License Manager 930, servers 934, 936, 938, and 940, and main network device 944) are mounted in a single rack with sbX™ server 928. Accordingly, many or all such devices will sometimes be referenced in the aggregate as an "sbX™ server." However, in alternative implementations, one or more of these devices is in communication with sbX™ server 928 and/or other devices of the network but located elsewhere. For example, some of the devices could be mounted in separate racks within computer room 904 or located elsewhere on the network. Moreover, in some implementations large volumes of data may be stored elsewhere, e.g., via a storage area network ("SAN").

Computer room 904 may include one or more operator consoles or other host devices that are configured for communication with other devices within and outside of computer room 904. Such host devices may be provided with software, hardware and/or firmware for implementing functions described herein. However, such host devices need not be located within computer room 904. Wired host devices 942 (which are desktop and laptop computers in this example) and wireless devices 924 (which are PDAs in this example) may be located elsewhere in gaming establishment 906 or at a remote location.

Some embodiments include devices for implementing access control, security and/or other functions relating to the communication between different devices on the network. One or more devices in central system 908 may also be configured to perform, at least in part, tasks specific to embodiments of the present invention. For example, one or more servers 946, storage devices and/or host devices 942 of central system 908 may be configured to implement the functions described in detail elsewhere herein. One or more servers 946, storage devices 948 and/or host devices 942 of central system 908 may maintain player account information.

Some gaming networks 900 provide features for gaming tables that are similar to those provided for gaming machines, including but not limited to bonusing, player loyalty/player tracking, the use of cashless instruments, etc. Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras 950, radio frequency identification devices 952 and 954, etc., may be used to identify and/or track patrons, playing cards, chips, etc. Some of the gaming tables 922 may be configured for communication with individual player terminals (not shown), which may be configured to accept bets, present an electronic representation of a dealer, provide service application window information relating to a specified EGM, and/or indicate game outcomes, etc.

Moreover, some such automated gaming tables 922 and/or associated player terminals may include, or may be configured for communication with, a device that includes a coin-out meter, a ticket reader, a card reader, a ticket printer, and/or other related features. In some implementations, one such device may provide such functionality to a plurality of automated gaming tables 922 and/or associated player terminals.

Gaming establishment 906 also includes networked kiosks 956. Kiosks 956 may include card readers, ticket readers, printers, a user interface system, one or more displays, etc. Depending on the implementation, kiosks 956 may be used for various purposes, including but not limited to cashing out, prize redemption, redeeming points from a player loyalty program, redeeming "cashless" indicia such as bonus tickets, smart cards, etc.

Kiosks 956 may be configured to read information from, and/or write information to, a portable instrument such as a smart card, a ticket, a card having a magnetic strip, etc. The corresponding gaming devices are preferably configured for communication with such kiosks 956 and vice versa. Accordingly, some such kiosks 956 may include a wireless interface that is configured for communication with mobile gaming devices 924.

In the exemplary embodiment, each bank 920 has a corresponding switch 958. Each switch 958 is configured for communication with one or more devices in computer room 904 via main network device 944, which combines switching and routing functionality in this example. Although various communication protocols may be used, some preferred implementations use the Gaming Standards Association's G2S Message Protocol. Some systems may use a gaming-industry-specific transport layer called CASH™, which offers additional functionality and security.

Gaming establishment 906 may also include an RFID network, implemented in part by RFID switches 960 and multiple RFID readers 952. An RFID network may be used, for example, to track objects such as mobile gaming devices 924, which include RFID tags 954, patrons, chips, player loyalty devices, etc., in the vicinity of gaming establishment 906.

Various alternative network topologies can be used to implement different aspects of the invention and/or to accommodate varying numbers of networked devices. For example, some gaming establishments may include cameras 950 for implementing advanced player tracking, player navigation or other functionality. Gaming establishments with large numbers of gaming machines 918 may require multiple instances of some network devices (e.g., of main network device 944, which combines switching and routing functionality in this example) and/or the inclusion of other network devices not shown in FIG. 9. Some embodiments may include one or more middleware servers disposed between kiosks 956, RFID switches 960 and/or bank switches 958 and one or more devices (e.g., a corresponding server, router or other network device) in computer room 904. Such middleware servers can provide various useful functions, including but not limited to the filtering and/or aggregation of data received from switches, from individual gaming machines and from other devices. Some implementations of the invention include load-balancing methods and devices for otherwise managing network traffic.

Figure 10:
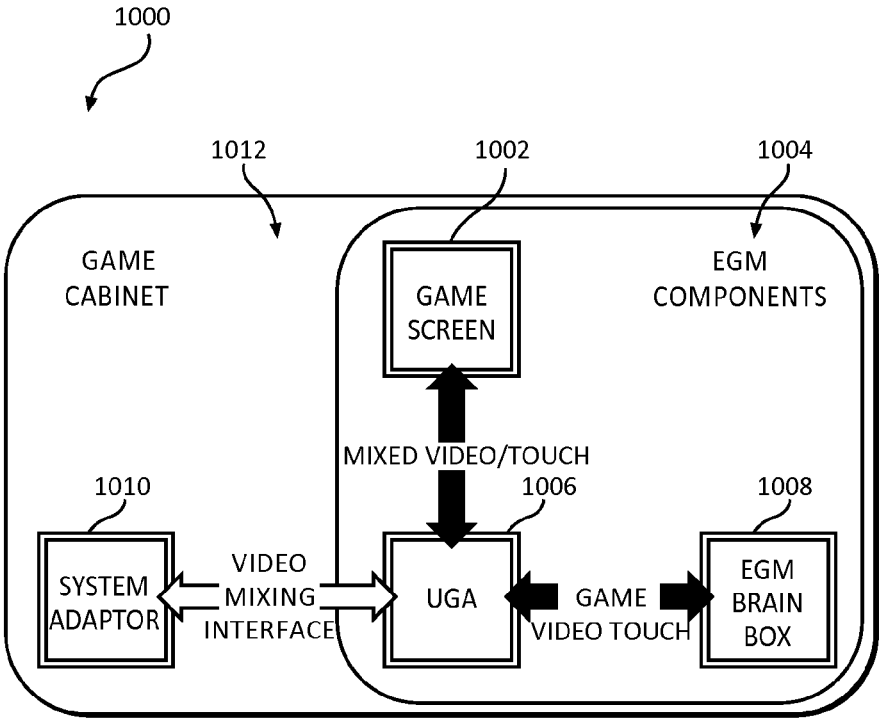
FIG. 10 is a schematic block diagram of a server-based gaming network with a system adaptor and a UGA for a service window in which aspects of the present invention may be realized.

As mentioned above, a gaming system identifies, from a gaming network having a cluster of electronic gaming machines (EGMs), those of the EGMs having an availability and unavailability for use. In one embodiment, the gaming system may use a service window. Those of the EGMs having the availability and unavailability for use are organized in the service window. A user selects one of the organized EGMs that are available and/or unoccupied for use. FIG. 10 is a schematic block diagram of a server-based gaming network with a system adaptor and Universal Game Adaptor (UGA) for a service window in which aspects of the present invention may be realized. As illustrated in FIG. 10, a game cabinet 1012 is illustrated along with various EGM 1004 components. In one embodiment, the EGM 1004 includes the UGA 1006 in communication with the game screen 1002, the EGM brain box 1008, and at least one system adaptor 1010. In one embodiment, a complete service window may be incorporated into all UGA-ready EGMs.

In one embodiment, as described herein, a gaming system, such as IGT® sbX™, uses a service window application. The service windows (e.g., an information window) is capable of running applications that may be used to perform a variety of service activities, such as booking tickets, ordering food and beverages, playing the EGT's and the like. These service windows applications talk with the gaming system (e.g., the sbX™) to acquire the required information. In one embodiment, the service window application allows operators to dynamically message players at the EGM, regardless of whether the EGM is a legacy or modern EGM. In one embodiment, the service window provides a solution to modernize a gaming venue, regardless of manufacturers' adoption of the GSA open standard interface, by using a service window (e.g., IGT® Service Window) with the UGA 1006 that may support a pathway to creating a G2S mixed floor. This is a key differentiator from other game manufacturers who are limited to SAS in bonusing depth and ability to upgrade and have access to a broader spectrum of games in an EGM. The service window delivers the desired player experience to all games, both modern and legacy, with the ability to deliver new and/or existing gaming themes as well as a refreshed look and feel to the brand. Changes are made in a within minutes, and as the gaming venue needs change, these changes may be applied to the entire gaming venue. In one embodiment, the service window allows for EGM operators to deliver gaming venue-specific and personalized offers to players/users to enhance the entire gaming experience at the EGM. Allowing for an integrated interface provides user with additional information regarding entertainment and other available offerings on the gaming venue property.

In one embodiment, the service window (e.g., IGT's service window) enables EGMs and/or casino management to interact with players/users directly at a terminal in real-time. In one embodiment, a service window may appear at one or more edges, or other predetermined locations, of the gaming screen of the EGM, and/or external application in communication with the EGM, and slides the game across, without effecting gameplay. In one embodiment, the service window (e.g., an information window) is built in flash, graphical user interface (GUI), and other application platforms for user interaction with the EGM, and EGM operators are given a platform to produce branded content and custom-built applications. This provides a gaming venue (e.g., a casino) a one-to-one communication channel with consumers with a large range of marketing and up-sale opportunities. Installation of an add-on device may be used and is a process without the need for any reconfiguration or rewiring. In one embodiment, by ensuring a game manufacturer offers its own firmware and certification; the service window display may be fully supported by an original manufacturer. In one embodiment, system adaptors 1010 (e.g., IGT system adaptors) may be employed and work in conjunction with the UGA 1006 and add the ability to translate older game protocols to the latest game-to-system G2S protocol and display player communications on a secondary display or on the game screen. This allows for a high-speed network, which enables for a transference of real time data between the EGM and the system, delivering instant communication to the player in the way of offers and bonuses. The UGA 1006 may add value to an entire line of EGMs 1004 (e.g., the entire line of IGT 80960 EGMs), allowing the service window function to operate in all legacy and new game systems. In addition to allowing for the implementation of real-time communication on all IGT games, the UGA 1006 may also function on various types of EGMs manufactured by one or more manufactures through extended interoperability program based on the open GSA 1006 standard called GDS. This program will allows operators to deliver rich media across a mixed gaming venue through the service window on most manufacturers' EGMs, thus ensuring a standardized, gaming venue implementation.

Thus, in one embodiment, using a service window, the present invention creates a new service window application that may be used by the user playing one or more of the EGMs. This service window application is capable of displaying an organized list of identified EGMs that are located in one or more defined gaming venues (e.g., a casino floor providing one or more EGMs). The user of the EGM may select favorite and/or preferred EGMs and the service window application will provide and display to the user one or more maps to the EGMs that includes the user's favorite and/or preferred game. Each EGM displays in the service window either an unavailable status (not available for play), occupied status (e.g., currently being used by an user), unoccupied status, and/or an available for play status. If the EGMs are cluttered, sporadically located, and/or are shown as having an occupied indication/status, then a user would be able to select an alternative EGM and/or group of EGMs and find a route to those favored and/or preferred EGMs from the current location of the user. When the user selects a particular one of the user's favorite and/or preferred EGM, the service window (e.g., information window) would show if the selected EGM is occupied or unoccupied and/or unavailable or available for play. In one embodiment, the service window is in communication with an external application and provides the data of the service window to the external application.

In one embodiment, a percentage of occupancy and a percentage of unoccupancy may also be displayed in the service window. For example, in one embodiment, if a user selects a group of EGMs, which is running the users favorite and/or preferred EGMs, then the service window application would show the percentage of occupancy. The service window application may obtain various pieces of information from the gaming system of one or more of the EGMs. For example, a gaming system may harvest various pieces of data and may obtain this information, for example, from the using player coin in or wager information.

For players who want to play on the same EGM/game on which they have previously received jackpots, awards, promotional items, monetary awards, or other gaming awards, if that EGM is occupied and/or unavailable for play, the application may calculate and display an approximate time in which that favorite and/or preferred EGM, to which the EGM/Service window application is connected, will be available for play and/or unoccupied based on statistics pulled and calculated from the system and/or time required to make the EGM available to play (e.g., switching a gaming theme on the EGM to the users favorite and/or preferred gaming theme by the gaming venue) with the users favorite and/or preferred gaming theme.

Figure 11:
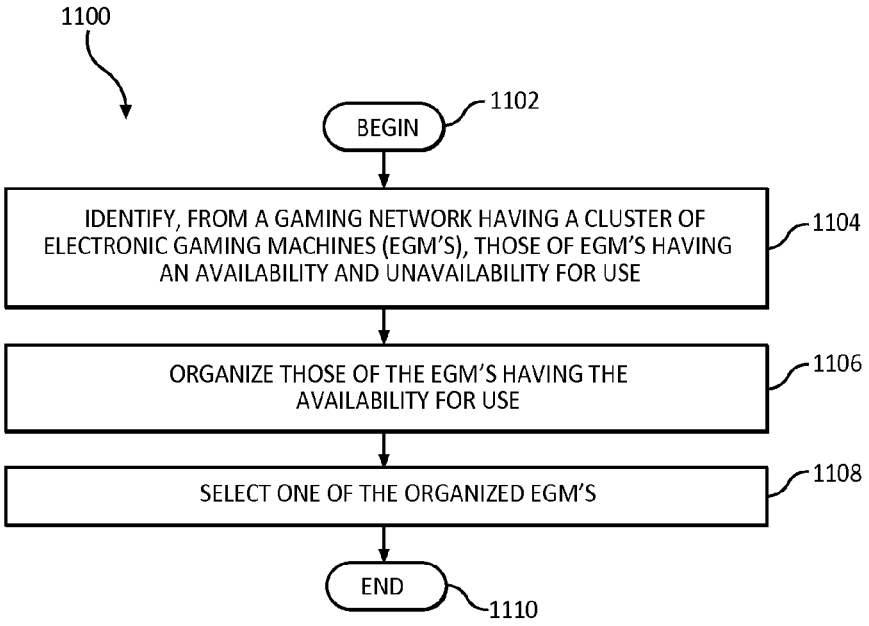
FIG. 11 is a flow chart illustrating an exemplary method for identifying and organizing electronic gaming machines (EGMs) having an availability and unavailability for use for allowing a user to select one of the EGMs in which aspects of the present invention may be realized.

FIG. 11 is a flow chart illustrating an exemplary method 1100 for identifying and organizing electronic gaming machines (EGMs) having an availability and unavailability for use for allowing a user to select one of the EGMs in which aspects of the present invention may be realized. The method 1100 begins (step 1102) by identifying, from a gaming network having a cluster of electronic gaming machines (EGMs), those of EGMs having an availability and unavailability for use (step 1104). Those of the EGMs having the availability for use are organized (step 1106). One of the organized EGMs is selected (e.g., selected by a user) (step 1108). The method 1100 ends (step 1110).

Figure 12A:
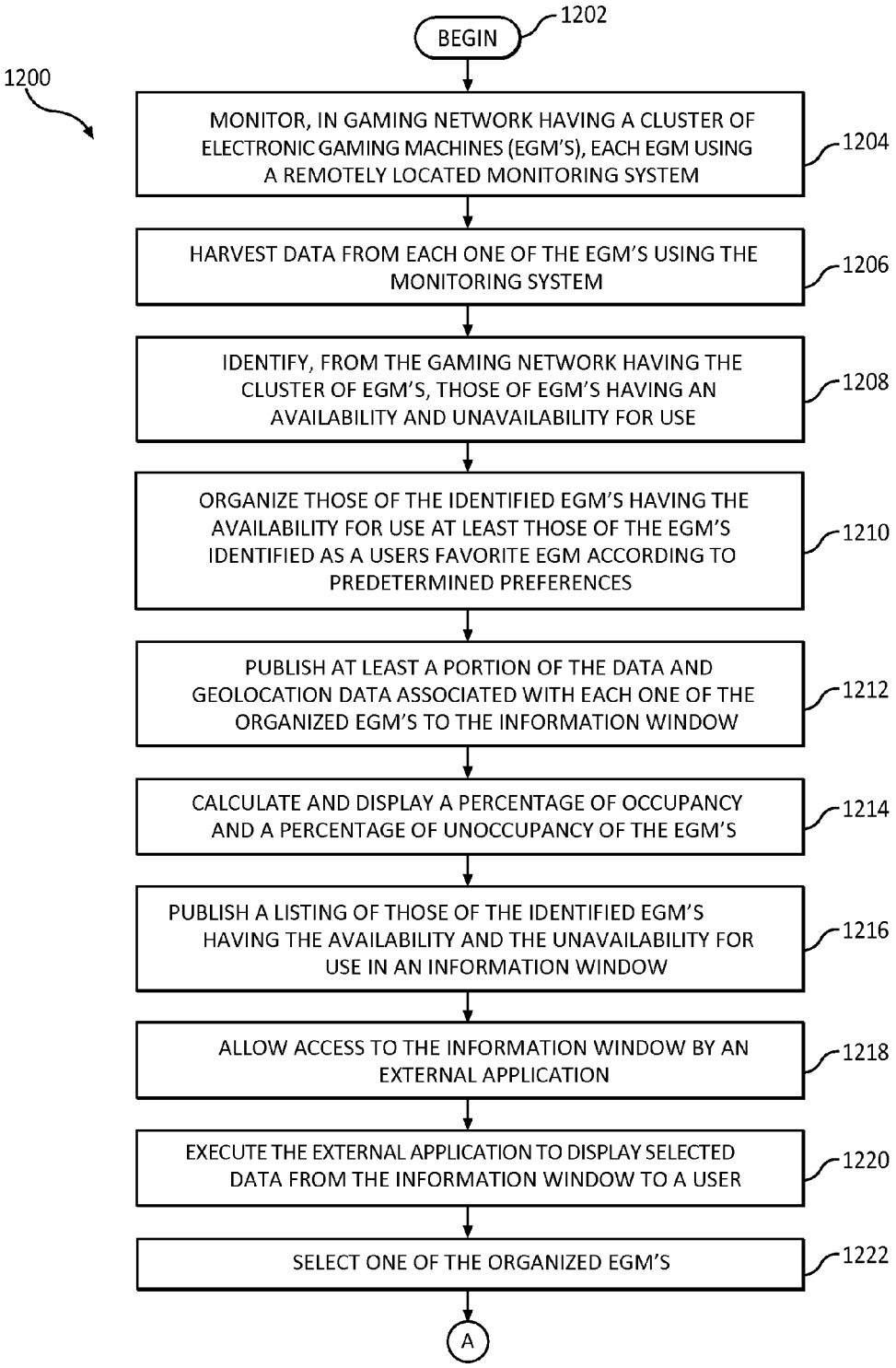
FIG. 12A-B is a flow chart illustrating an alternative exemplary method for identifying and organizing electronic gaming machines (EGMs) having an availability and unavailability for use for allowing a user to select one of the EGMs in which aspects of the present invention may be realized.
Figure 12B:
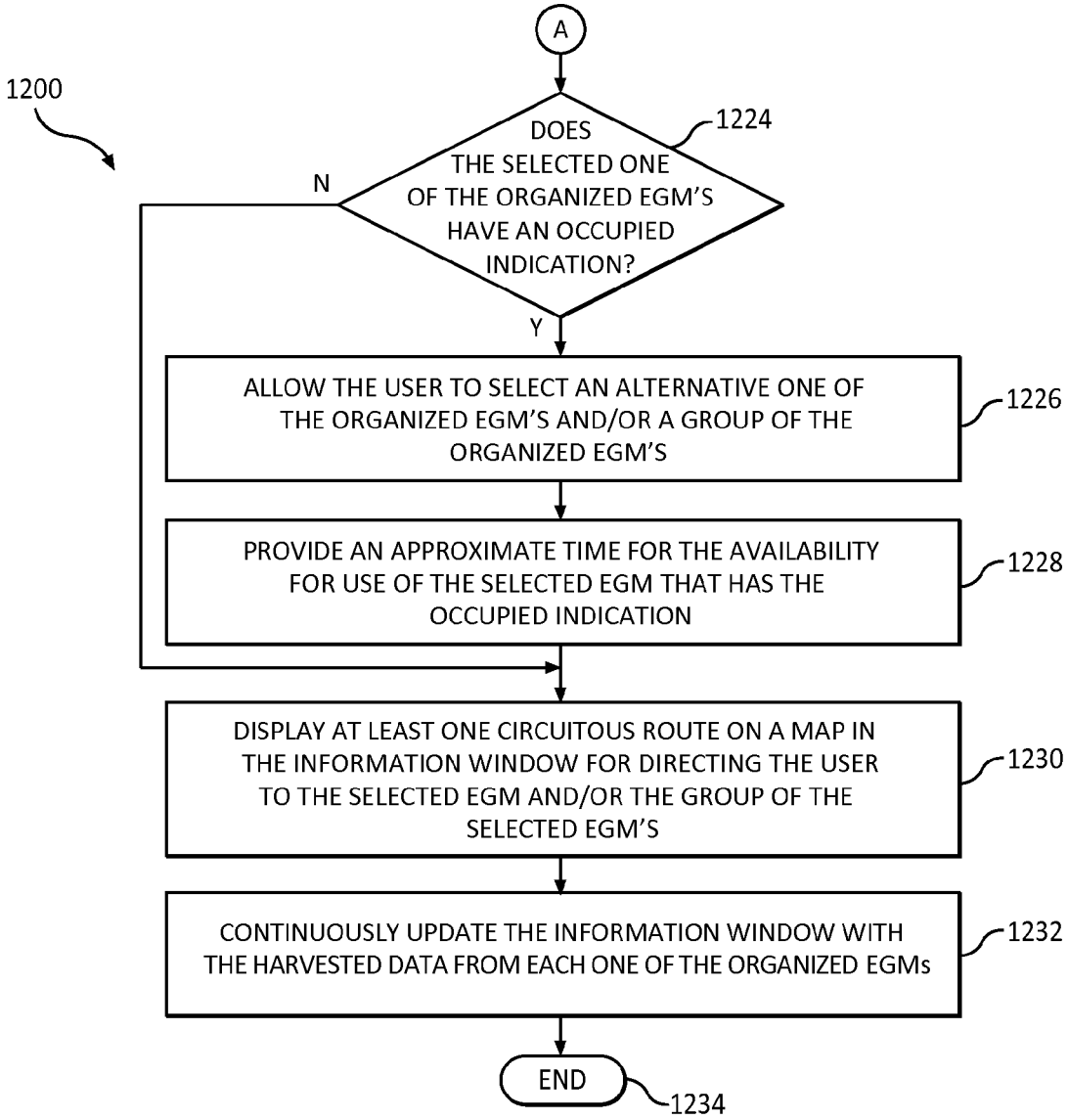

FIG. 12 (illustrated as FIG. 12A-B in the figures) is a flow chart illustrating an alternative exemplary method 1200 for identifying and organizing electronic gaming machines (EGMs) having an availability and unavailability for use for allowing a user to select one of the EGMs in which aspects of the present invention may be realized. The method 1200 begins (step 1202) by monitoring, in gaming network having a cluster of electronic gaming machines (EGMs), each EGM using a remotely located monitoring system (step 1204). Data is harvested from each one of the EGMs using the monitoring system (step 1206). The method 1200 identifies, from the gaming network having the cluster of EGMs, those of EGMs having an availability and unavailability for use (step 1208). The method 1200 organizes those of the identified EGMs, having the availability for use and/or unavailability for use, at least those of the EGMs identified as a users favorite EGM according to predetermined preferences (step 1210). The method 1200 publishes at least a portion of the data and/or geolocation data associated with each one of the organized EGMs to the information window (e.g., a service window application) (step 1212). The method 1200 calculates and displays a percentage of occupancy and a percentage of unoccupancy of the EGMs (step 1214). The method 1200 publishes a listing of those of the identified EGMs having the availability and the unavailability for use in an information window (step 1216). The method 1200 allows access to the information window (e.g., a service window application) by an external application (step 1218). The method 1200 executes an external application to display selected data from the information window to a user (step 1220). A user selects one of the organized EGMs (e.g., the user selects a favorite EGM) (step 1222). The method 1200 determines if the selected one of the organized EGMs has an occupied indication (step 1224). If yes, the method 1200 allows the user to select an alternative one of the organized EGMs and/or a group of the organized EGMs (e.g., a user selects one or more favorite EGMs) (step 1226). The method 1200 provides an approximate time for the availability for use of the selected EGM that has the occupied indication (step 1228). If the selected one of the organized EGMs has an unoccupied indication, the method 1200 displays at least one circuitous route on a map in the information window for directing the user to the selected EGM (from step 1222) and/or the alternative one or the group of the selected EGMs (from step 1226) (step 1230). The method 1200 continuously updates the information window in real time with the harvested data (e.g., harvested in real time) from each one of the organized EGMs (step 1232).

In one embodiment, the methods of FIGS. 11 and 12, and the additional embodiments and described herein, may access the information window (e.g., a service window application) by an external application. The external application may be used to display selected data from the information window to a user using a service window. To protect the integrity and provide additional security for securing accessing one of the EGMs, the external application (e.g., a smart phone, an electronic tablet, a computer, and the like) and/or the EGM may be configured a biometric technology.

Figure 13A:
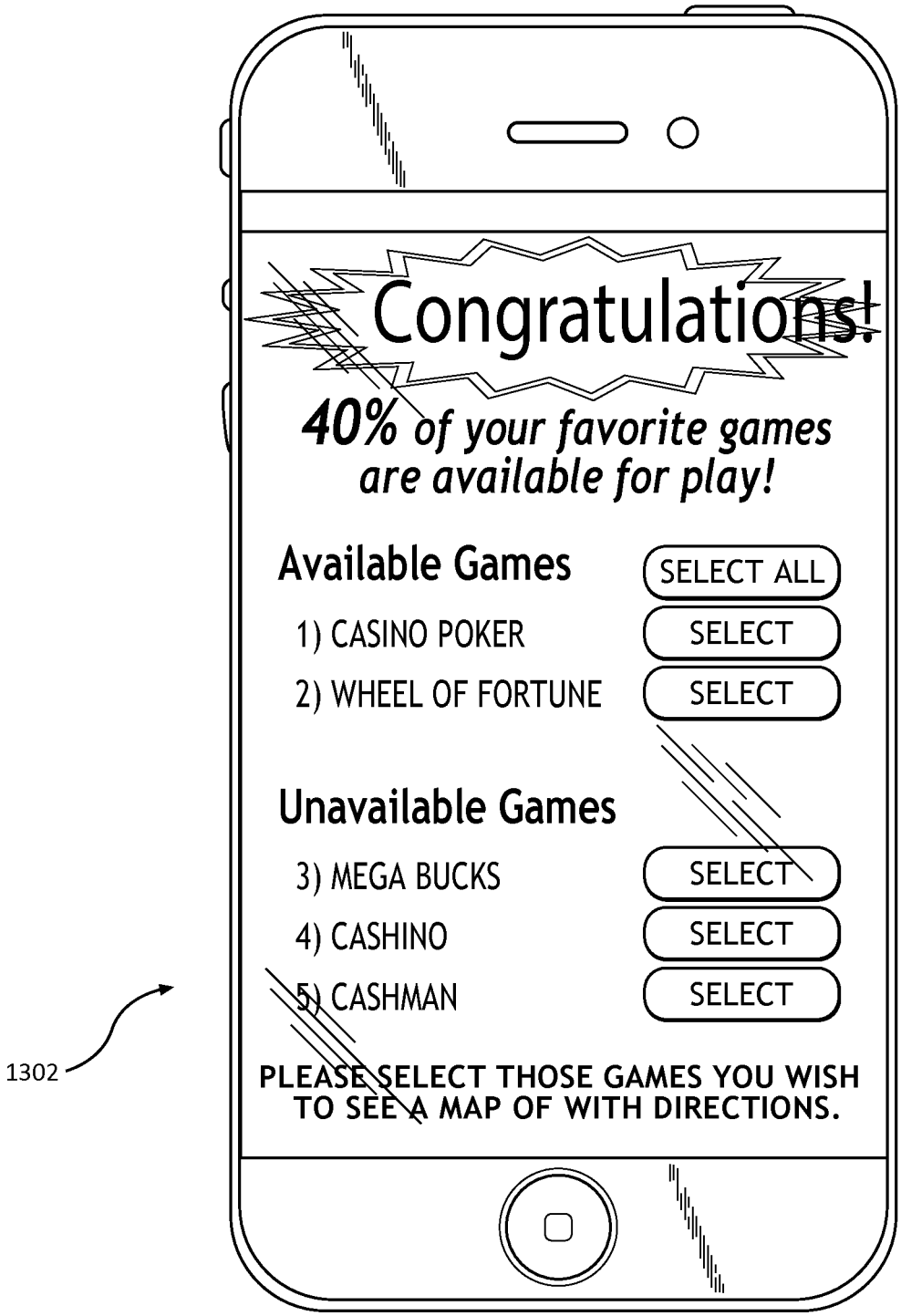
FIG. 13A-C are block diagrams illustrating an exemplary an external application displaying the identified and organized electronic gaming machines (EGMs) having an availability and unavailability for use for allowing a user to select one of the EGMs in which aspects of the present invention may be realized.
Figure 13B:
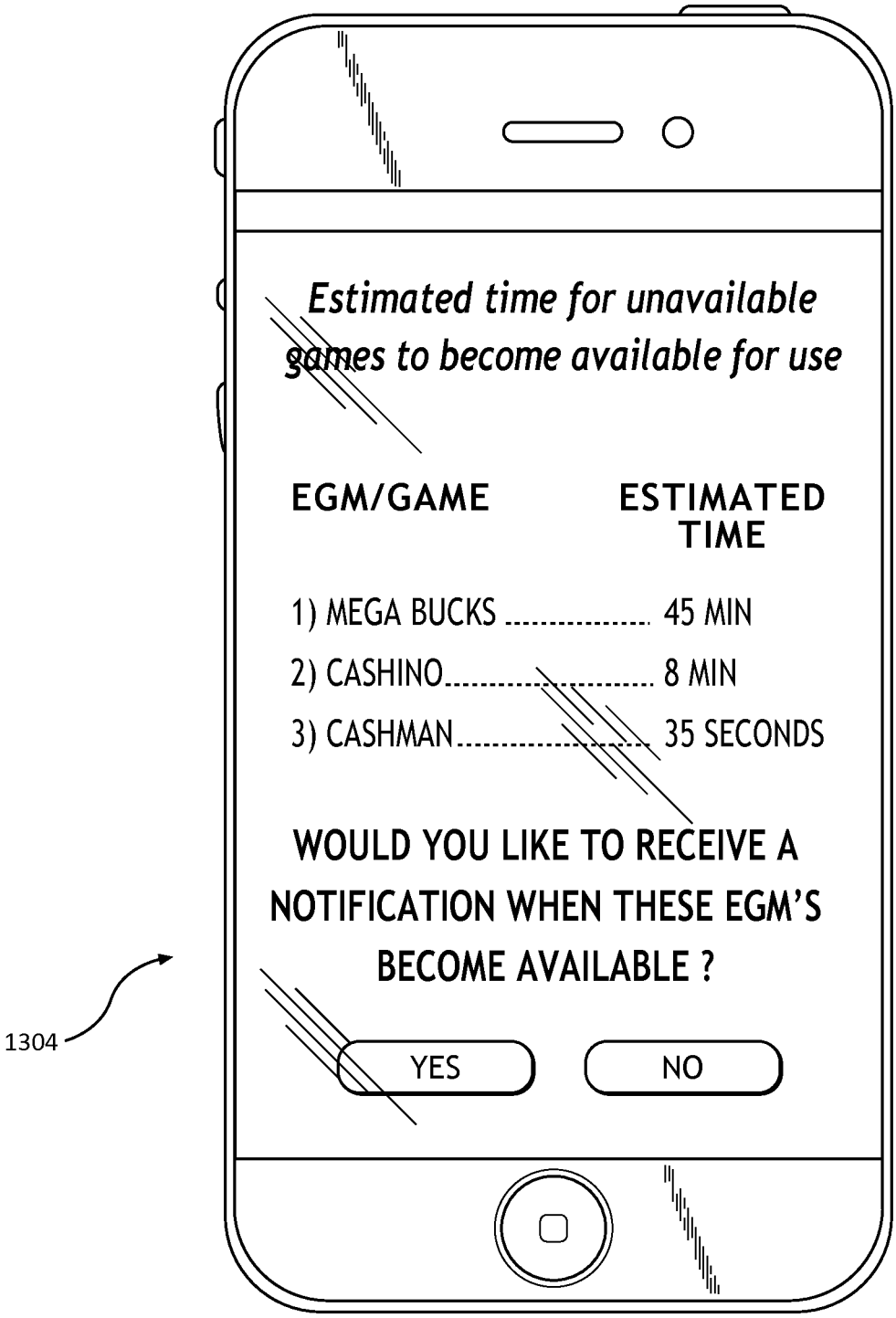
Figure 13C:
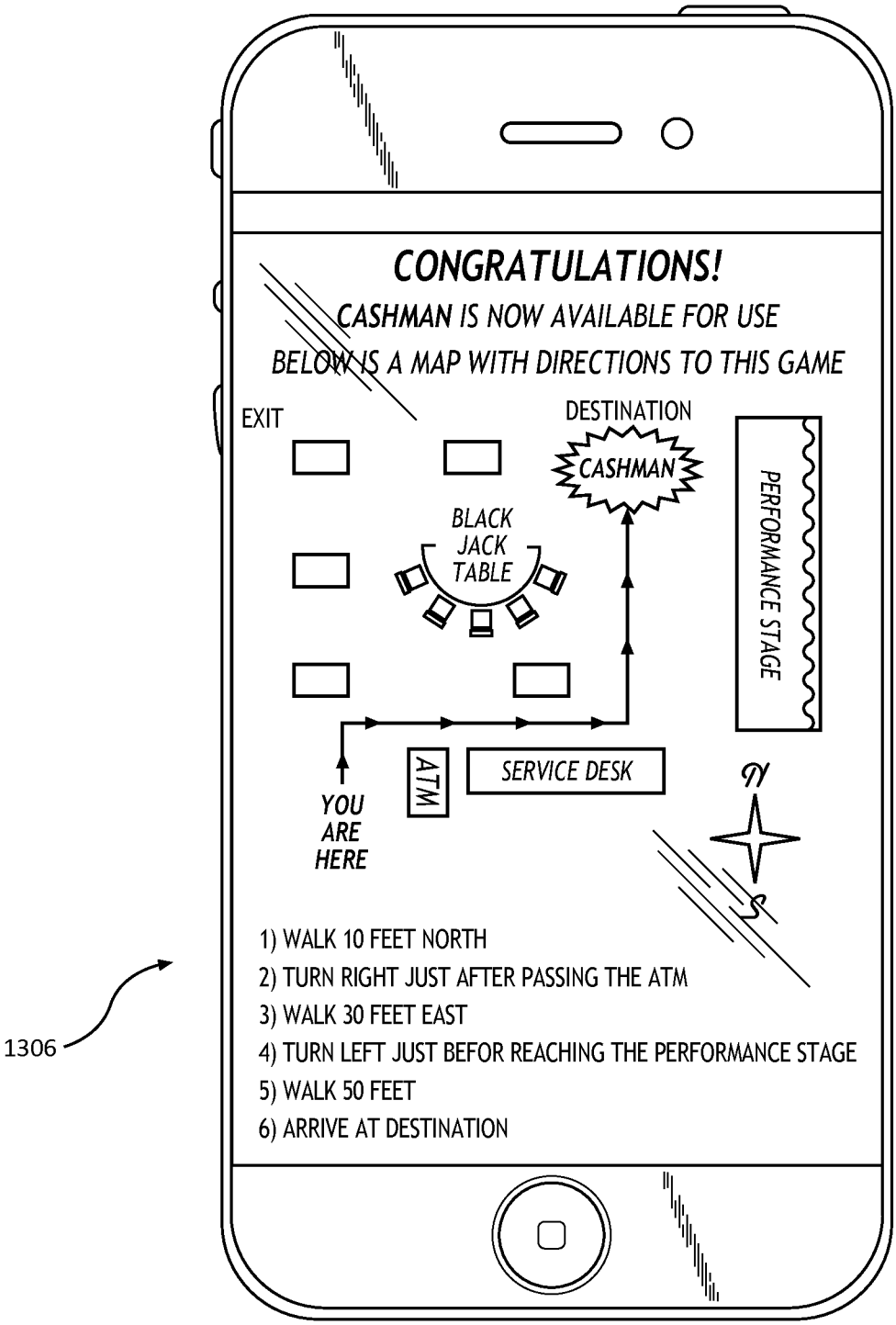

FIG. 13A-C are block diagrams illustrating an exemplary an external application displaying the identified and organized electronic gaming machines (EGMs) having an availability and unavailability for use for allowing a user to select one of the EGMs in which aspects of the present invention may be realized. FIGS. 13A-C are each related are shown as one continuous example of the consecutive window screens on an external application device and/or an EGM that a player may be shown. In other embodiments, the displayed data may be altered, changed, and customized based on the gaming venue preferences, manufactures specification and technical abilities, and/or gaming commission regulations. As illustrated in FIG. 13A, an external application 1302 (e.g., a smart phone, an electronic tablet, a computer, and the like) using a service window application and using a server-based gaming network (e.g., sbX™ network), servers (e.g., sbX™ servers), and/or hosts of the gaming network, identify, from the gaming network having a cluster of electronic gaming machines (EGMs), those of the EGMs having an availability and unavailability for use. In one embodiment, the player enters a most preferred and/or a group of most preferred (e.g., favorite) games/EGMs. Those EGMs having the availability for use are organized according to one or more predetermined preferences (e.g., user preferences). It should be noted that the external application is used as an example and an actual EGM may also be used and substituted herein with all the data displayed and used in FIGS. 13A-C being displayed and used in a service window application of the EGM itself. FIG. 13A shows the external application 1302 a success notice indicating at least 40% of the user's most favorite and/or preferred game(s) are available; specifically, that the players favorite/preferred games of 1) CASINO POKER and 2) WHEEL OF FORTUNE are currently available (e.g., available for use, unoccupied, and/or no gaming activity is occurring on these EGMs) for play. (A percentage of occupancy and a percentage of unoccupancy of each of the EGMs may also be displayed). The user's most favorite and/or preferred game(s) that are not available (e.g., unavailable for use, occupied, and/or gaming activity is occurring on these EGMs) are shown as 3) MEGA BUCKS, 4) CASHINO, and 5) CASHMAN. A user then selects one of and/or all of the organized EGMs for which of those EGMs the user wishes to see a map of with directions to these EGMs (e.g., circuitous routes may be on the map in the external application device window 1302 and/or EGM for directing the user to the one of the organized EGMs (e.g., to one or more of the favorite and/or preferred EGMs). For example, as will be described below, a user may select to see a map of 1) CASINO POKER and 3) MEGA BUCKS, or the user may choose the "select all" button and a map with directions to each of these selected EGMs will appear in the external device and/or in an EGM the user is currently using.

As illustrated in FIG. 13B, an external application 1304 provides an approximate time for the availability for use of any of the selected EGM(s) that has the occupied indication. The external application 1304 shows that 1) MEGA BUCKS will be available for play in 45 minute, 2) CASHINO will be available for play in 8 minutes, and 3) CASHMAN will be available for play in 35 seconds. The user is then provided with the option to receive one of a various types of notifications/alerts thereby notifying the user when one or more of these EGMs become available. The application may be configured such that the system may be preconfigured for providing the notification automatically without requesting the user for manual input.

As illustrated in FIG. 13C, an external application 1304 provides the map of with directions to these EGMs (e.g., circuitous routes may be on the map in the external application device window 1302 and/or EGMs for directing the user to the one of the organized EGMs (e.g., to one or more of the favorite and/or preferred EGMs). The external application 1304 a success notice indicating that the EGM "CASHMAN," which was previously occupied and/or unavailable for use, as illustrated in FIG. 13A, has now become available for use with the map listed below with directions to the CASHMAN EGM. In one embodiment, the layout design and configuration of the gaming venue floor is displayed to the user. If the user was located outside of the gaming venue, alternative maps may be shown and as the user enters the gaming venue, an updated map showing the casino floor may be seamlessly transitioned for display on the user's external application device. Since the user was inside of the gaming venue, as observed in FIG. 13, the directions of steps 1-6 are listed below the map; 1) walk 10 feet north, 2) turn right just after passing the ATM, 3) walk 30 feet east, 4) turn left just before reaching the performance stage, 5) walk 50 feet, and 6)

arrive at the destination "CASHMAN." Depending on the location of the user/player, the geolocation of both the EGM and the external application device may be used in the map and be updated in real time for showing real time location and progress of the user as the user approaches the destination EGM. For example, using the geolocation data of the external device, the map will continuously show the location in real time of the user. In one embodiment, the user may see a blinking cursor, dot, human image, and/or any other type of symbol traveling along the circuitous route on the map and also an audible voice and/alert will indicate to the user when to turn, stop, and/or proceed based upon the displayed directions.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

Program code embodied on a computer readable medium may be transmitted using any appropriate medium, including but not limited to wireless, wired, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention have been described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that may direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the above figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

What is claimed is:

1. A method for processing data in a gaming system having at least one processor device, the method comprising:

identifying, using the at least one processor device, from a gaming network having a cluster of a plurality of electronic gaming machines (EGMs) wherein each EGM includes either a user non-preferred game or a user preferred game, those of the plurality of EGMs being available or unavailable for use;

organizing, using the at least one processor device, those of the plurality of EGMs having the user preferred game available for use and those of the plurality of EGMs having the user preferred game unavailable for use;

publishing in an information window a listing of those of the plurality of EGMs identified as having the user preferred game available for use and those of the plurality of EGMs having the user preferred game unavailable for use;

providing an approximate time for the availability for use of one of those of the plurality of EGMs having the user preferred game unavailable for use;

receiving a user selection of at least one of the plurality of EGMs having the user preferred game unavailable for use;

sending a notification to a managing application after the user selection of at least one of the plurality of EGMs having the user preferred game unavailable for use;

the managing application replacing the user non-preferred game on one of the plurality of EGMs having the user non-preferred game available for use with the user preferred game;

the managing application sending a notification to the user that the EGM previously having the user non-preferred game and now having the user preferred game is available for use; and displaying at least one of a plurality of circuitous routes on a map in the information window for directing the user to the EGM previously having the user non-preferred game and currently having the user preferred game which is available for use.

2. The method of claim 1, further including organizing those of the plurality of EGMs having the user preferred game available for use according to a plurality of predetermined preferences.

3. The method of claim 1, further including displaying a percentage of occupancy and a percentage of unoccupancy of the plurality of EGMs.

4. The method of claim 3, wherein the listing of those of the plurality of EGMs identified as having the user preferred game available and unavailable for use includes both occupied ones of the plurality of EGMs.

5. The method of claim 3, further including performing one of:

selecting a group of the organized plurality of EGMs;

displaying the percentage of occupancy for the group of the organized plurality of EGMs selected by the user;

displaying at least one of the plurality of circuitous routes on the map for each one of the organized plurality of EGMs; and displaying at least one of the plurality of circuitous routes on the map in the information window for each one of the organized plurality of EGMs selected by the user with an availability indication and an unavailability indication.

6. The method of claim 1, further including performing one of:

monitoring each one of the organized plurality of EGMs using a monitoring system remotely located in the gaming network;

harvesting a plurality of data from each one of the organized plurality of EGMs using the monitoring system, wherein the plurality of data includes at least statistical information, historical use information associated with each one of the organized plurality of EGMs and the user, accounting information, wagering data, and gaming and members profile information associated with the user;

publishing at least a portion of the plurality of data and geolocation data associated with each one of the organized plurality of EGMs to the information window; and updating the information window with the plurality of harvested data from each one of the organized plurality of EGMs.

7. The method of claim 1, further including performing one of:

allowing access to the information window by an external application; and executing the external application to display selected data from the information window to the user.

8. A system for processing data in a gaming environment having an available plurality of gaming devices, the system comprising:

a gaming network;

a cluster of a plurality of electronic gaming machines (EGMs) in the gaming network;

at least one master controller in communication with each of the cluster of the plurality of EGMs; and at least one processor device, in communication with the at least one master controller, operable on each one of the plurality of gaming devices, wherein the at least one processor device:

identifies, from the gaming network having the cluster of the plurality of EGMs, wherein each EGM includes either a user non-preferred game or a user preferred game, those of the plurality of EGMs being available or unavailable for use;

organizes those of the plurality of EGMs having the user preferred game available for use and those of the plurality of EGMs having the user preferred game unavailable for use;

publishes in an information window a listing of those of the plurality of EGMs identified as having the user preferred game available for use and those of the plurality of EGMs having the user preferred game unavailable for use provides an approximate time for the availability for use of one of those of the plurality of EGMs having the user preferred game unavailable for use;

receives a user selection of at least one of those of the plurality of EGMs having the user preferred game unavailable for use;

sends a notification to a managing application after the user selection of at least one of the plurality of EGMs having the user preferred game unavailable for use;

the manager application, replaces the user non-preferred game on one of the plurality of EGMs having the user non-preferred game available for use with the user preferred game;

the managing application sends a notification that the EGM previously having the user non-preferred game and now having the user preferred game is available for use; and displays at least one of a plurality of circuitous routes on a map in the information window for directing the user to the EGM previously having the user non-preferred game and currently having the user preferred game which is available for use.

9. The system of claim 8, wherein the at least one processor device organizes those of the plurality of EGMs having the user preferred game available for use according to a plurality of predetermined preferences.

10. The system of claim 8, wherein the at least one processor device displays a percentage of occupancy and a percentage of unoccupancy of the plurality of EGMs.

11. The system of claim 10, wherein the listing of those of the plurality of EGMs identified as having the user preferred game available and unavailable for use includes both occupied and unoccupied ones of the plurality of EGMs.

12. The system of claim 11, wherein the at least one processor device performs one of:

selecting a group of the organized plurality of EGMs;

displaying the percentage of occupancy for the group of the organized plurality of EGMs selected by the user;

displaying at least one of the plurality of circuitous routes on the map for each one of the organized plurality of EGMs; and displaying at least one of the plurality of circuitous routes on the map in the information window for each one of the organized plurality of EGMs selected by the user with an availability indication and an unavailability indication.

13. The system of claim 8, wherein the at least one processor device performs one of:

monitoring each one of the organized plurality of EGMs using a monitoring system remotely located in the gaming network;

harvesting a plurality of data from each one of the organized plurality of EGMs using the monitoring system, wherein the plurality of data includes at least statistical information, historical use information associated with each one of the organized plurality of EGMs and the user, accounting information, wagering data, and gaming and members profile information associated with the user;

publishing at least a portion of the plurality of data and geolocation data associated with each one of the organized plurality of EGMs to the information window; and updating the information window with the plurality of harvested data from each one of the organized plurality of EGMs.

14. The system of claim 8, wherein the at least one processor device performs one of:

allowing access to the information window by an external application;

executing the external application to display selected data from the information window to the user.

15. A computer program product for processing data in a gaming environment with at least one processor device, the computer program product comprising a non-transitory computer-readable storage medium having computer-readable program code portions stored therein, the computer-readable program code portions comprising:

a first executable portion that identifies, from a gaming network having a cluster of a plurality of electronic gaming machines (EGMs), wherein each EGM includes either a user non-preferred game or a user preferred game, those of the plurality of EGMs available or unavailable for use;

a second executable portion that organizes those of the plurality of EGMs having the user preferred game available for use and those of the plurality of EGMs having the user preferred game unavailable for use;

a third executable portion for publishing in an information window a listing of those of the plurality of EGMs identified as having the user preferred game available for use and those of the plurality of EGMs having the user preferred game unavailable for use;

a fourth executable portion for providing an approximate time for the availability for use of one of those of the plurality of EGMs having the user preferred game unavailable for use;

a fifth executable portion for receiving a user selection of at least one of those of the plurality of EGMs having the user preferred game unavailable for use;

a sixth executable portion for sending a notification to a managing application after the user selection of at least one of the plurality of EGMs having the user preferred game unavailable for use;

a seventh executable portion for replacing, by a managing application, the user non-preferred game on one of the plurality of EGMs having the user non-preferred game available for use with the user preferred game;

an eighth executable portion for sending, by the managing application, a notification to the user that the EGM previously having the user non-preferred game and now having the user preferred game is available for use; and a ninth executable portion for displaying at least one of a plurality of circuitous routes on a map in the information window for directing the user to the EGM previously having the user non-preferred game and currently having the user preferred game which is available for use.

16. The computer program product of claim 15, further including a tenth executable portion that organizes those of the plurality of EGMs having the user preferred game available for use according to a plurality of predetermined preferences.

17. The computer program product of claim 15, further including a tenth executable portion that displays a percentage of occupancy and a percentage of unoccupancy of the plurality of EGMs.

18. The computer program product of claim 17, wherein the listing of those of the plurality of EGMs identified as having the user preferred game available and unavailable for use includes both occupied and unoccupied ones of the plurality of EGMs.

19. The computer program product of claim 17, further including an eleventh executable portion that performs one of:

selecting a group of the organized plurality of EGMs;

displaying the percentage of occupancy for the group of the organized plurality of EGMs selected by the user;

displaying at least one of the plurality of circuitous routes on the map for each one of the organized plurality of EGMs; and displaying at least one of plurality of circuitous routes on the map in an information window for each one of the organized plurality of EGMs selected by the user with an availability indication and the unavailability indication.

20. The computer program product of claim 15, further including a tenth executable portion that performs one of:

monitoring each one of the organized plurality of EGMs using a monitoring system remotely located in the gaming network;

harvesting a plurality of data from each one of the organized plurality of EGMs using the monitoring system, wherein the plurality of data includes at least statistical information, historical use information associated with each one of the organized plurality of EGMs and the user, accounting information, wagering data, and gaming and members profile information associated with the user;

publishing at least a portion of the plurality of data and geolocation data associated with each one of the organized plurality of EGMs to the information window; and updating the information window with the plurality of harvested data from each one of the organized plurality of EGMs.

21. The computer program product of claim 15, further including a tenth executable portion that performs one of:

allowing access to the information window by an external application;

executing the external application to display selected data from the information window to the user.

* * * * *